US006257689B1

(12) United States Patent
Yonekubo

(10) Patent No.: US 6,257,689 B1
(45) Date of Patent: Jul. 10, 2001

(54) PRINTER AND METHOD OF PRINTING

(75) Inventor: Shuji Yonekubo, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/364,060

(22) Filed: Jul. 30, 1999

(30) Foreign Application Priority Data

Jul. 31, 1998 (JP) ..... 10-230359
Jun. 17, 1999 (JP) ..... 11-170628

(51) Int. Cl.[7] ..... B41J 23/38; B41J 2/205; B41J 23/00

(52) U.S. Cl. ..... 347/11; 347/10; 347/14; 347/15; 347/37

(58) Field of Search ..... 347/9, 10, 11, 347/15, 37

(56) References Cited

U.S. PATENT DOCUMENTS 4,222,060 9/1980 Sato et al. ..... 347/9

FOREIGN PATENT DOCUMENTS 0 816 102 1/1998 (EP) ..... B41J/2/205
0 827 838 3/1998 (EP) ..... B41J/2/21

*Primary Examiner*—John Barlow
*Assistant Examiner*—Alfred Dudding
(74) *Attorney, Agent, or Firm*—Oblon, Spivak, McClelland, Maier & Neustadt, P.C.

(57) ABSTRACT

The technique of the present invention prevents a variation in hitting positions of two different types of ink droplets ejected in two pixels, which adjoin to each other in a main scanning direction, in response to a first driving pulse and a second driving pulse. The process of the invention drives each piezoelectric element on a print head in response to a driving signal, which may selectively include two different driving pulses in one recording cycle. When one dot is created in each of the two adjoining pixels in the main scanning direction, either a driving signal A or a driving signal B is generated to control the dot creation. The driving signal A includes a first pulse in a first cycle and a second pulse in a second cycle, whereas the driving signal B includes the second pulse in the first cycle and the first pulse in the second cycle. The process regulates an ejecting speed Vm1 of a small ink droplet corresponding to the first pulse, an ejecting speed Vm2 of a large ink droplet corresponding to the second pulse, and a variation in time difference between the ejecting timing of the first ink droplet and the ejecting timing of the second ink droplet in the case of the driving signal A and in the case of the driving signal B, according to a platen gap. This enables a distance S3 between the hitting positions of the small ink droplet and the large ink droplet in the case of the driving signal A to be equal to a distance S13 between the hitting positions of the small ink droplet and the large ink droplet in the case of the driving signal B.

20 Claims, 22 Drawing Sheets

PRINTER AND METHOD OF PRINTING

BACKGROUND OF THE INVENTION

1. Field of the Invention

The present invention relates to a technique of printing an image on a printing medium, and more specifically to a printing technique that records two pixels adjoining to each other in a main scanning direction with a plurality of ink droplets.

2. Description of the Related Art

Ink jet printers that eject ink droplets from a head are widely used as an output device of a computer. The conventional ink jet printers reproduce each pixel by only two values, that is, the on state and the off state. Multi-value printers, which have been proposed recently, on the other hand, reproduce each pixel by three or greater values.

One of such multi-value printers selectively ejects a first ink droplet, which has a relatively small quantity of ink, and a second ink droplet, which has a greater quantity of ink than that of the first ink droplet, in the area of one pixel. This configuration enables reproduction of four tones, that is, the state of no dot creation where neither the first ink droplet nor the second ink droplet is ejected, the state of small dot creation where only the first ink droplet is ejected, the state of medium dot creation where only the second ink droplet is ejected, and the state of large dot creation where both the first ink droplet and the second ink droplet are ejected. The arrangement of ejecting the two different types of ink droplets is actualized by driving the print head in response to a driving signal, which may selectively include a first driving pulse and a second driving pulse within one printing period corresponding to one pixel in printing.

In the prior art technique, there are some cases in which two different types of dots are created respectively in two pixels adjoining to each other in the main scanning direction in response to different driving pulses selected out of the first and the second driving pulses. The positions of these two adjoining dots in the main scanning direction created by the prior art technique are, however, varied to cause a positional deviation. Namely there is a difference between a first state, in which a dot is created in the first pixel in response to the first driving pulse and a dot is created in the latter pixel in response to the second driving pixel, and a second state, in which a dot is created in the first pixel in response to the second driving pulse and a dot is created in the latter pixel in response to the first driving pixel. The subsequent image processing does not practically distinguish between the first state and the second state. The prior art technique accordingly fails in faithful reproduction of print data of interest generated as a result of the image processing, which causes deterioration of the picture quality of the resulting printed image.

FIG. 25 shows the positions of two different types of dots, a small dot and a medium dot, created in the first state and in the second state. Lattices in FIG. 25 represent boundaries of pixel areas, and each square area defined by a lattice corresponds to the area of one pixel. An ink droplet is ejected from a print head (not shown) into each pixel, while the print head moves in the main scanning direction. In the example of FIG. 25, recording is carried out in the first state with regard to two pixels, a k-th pixel and a (k+1)-th pixel (where k is a positive number), that are included in a first raster line L1 and adjoin to each other in the main scanning direction. Recording is carried out in the second state, on the other hand, with regard to two pixels, a k-th pixel and a (k+1)-th pixel, that are included in a second raster line L2 and adjoin to each other in the main scanning direction.

As clearly understood from the drawing of FIG. 25, in the prior art technique, the hitting positions of the two ink droplets ejected in the two adjoining pixels, the k-th and (k+1)-th pixels, on the first raster line L1 are different from those on the second raster line L2. The ink droplet for recording the k-th pixel in the main scanning direction hits on the left half of the pixel area in the first raster line L1, but hits on the right half of the pixel area in the second raster line L2. On the contrary, the ink droplet for recording the (k+1)-th pixel hits on the right half of the pixel area in the first raster line L1, but hits on the left half of the pixel area in the second raster line L2. The subsequent image processing does not distinguish between the two dots on the first raster line L1 and the two dots on the second raster line L2. The small dot is, however, apart from the medium dot on the first raster line L1, whereas the medium dot is close to or even integrated with the small dot on the second raster line L2. This results in a density difference and roughness in the resulting reproduced image.

In the conventional multi-value ink jet printer, the hitting positions of the two different types of ink droplets in the main scanning direction, which are ejected in the two adjoining pixels, are varied in the first state and in the second state discussed above. The variation in hitting positions unfavorably deteriorates the picture quality of the resulting printed image.

SUMMARY OF THE INVENTION

The object of the present invention is thus to prevent deterioration of the picture quality of a resulting printed image, which is ascribed to a variation in hitting positions of two different types of ink droplets ejected in two pixels, which adjoin to each other in a main scanning direction, in response to different driving pulses selected out of a first driving pulse and a second driving pulse in a state where a dot is created in a first pixel in response to the first driving pulse and a dot is created in a latter pixel in response to the second driving pulse and in an inverted state.

At least part of the above and the other related objects is attained by a first printer that prints an image on a printing medium while carrying out a main scan that moves a print head relative to the printing medium. The first printer includes: the print head that has a plurality of nozzles and a plurality of pressure generating elements, which respectively correspond to the plurality of nozzles, each of the pressure generating elements being driven in response to a driving signal, so as to cause an ink droplet to be ejected from the corresponding nozzle against the printing medium; and a head driving control unit that controls the driving signal output to the print head and thereby causes the print head to print an image on the printing medium. The head driving control unit includes: a driving signal generating unit that generates the driving signal that selectively includes a first driving pulse and a second driving pulse in one printing period corresponding to one pixel in printing, a first driving pulse causing a first ink droplet to be ejected from each of the nozzles, a second driving pulse following the first driving pulse and causing a second ink droplet to be ejected from each of the nozzles; and a driving signal specification unit that specifies the first driving pulse and the second driving pulse, in order to cause three factors, that is, an ejecting speed of the first ink droplet towards the printing medium, an ejecting speed of the second ink droplet towards the printing medium, and a variation in time difference between the first driving pulse and the second driving pulse when the first driving pulse and the second driving pulse are respectively output to adjoining pixels in this sequence and in an inverted sequence, to satisfy a predetermined relationship, which depends upon a distance from a nozzle of interest to the printing medium, thereby causing a variation in distance between a hitting position of the first ink droplet and a hitting position of the second ink droplet when the first driving pulse and the second driving pulse are respectively output to the adjoining pixels in this sequence and in the inverted sequence to be within a preset value.

In the first printer of the above arrangement, the pressure generating element is driven in response to the driving signal that selectively include the first driving pulse and the second driving pulse, which respectively correspond to the first ink droplet and the second ink droplet, in one printing period corresponding to one pixel in printing. This arrangement enables two different types of ink droplets to be ejected from the corresponding nozzle on the print head. When two different types of dots are created in two pixels adjoining to each other in the main scanning direction, the first driving pulse and the second driving pulse may be output respectively in the two adjoining pixels in this sequence or in the inverted sequence. The driving signal specification unit specifies the first driving pulse and the second driving pulse, in order to cause three factors, that is, the ejecting speed of the first ink droplet towards the printing medium, the ejecting speed of the second ink droplet towards the printing medium, and the variation in time difference between the first driving pulse and the second driving pulse when the first driving pulse and the second driving pulse are respectively output to the adjoining pixels in this sequence and in an inverted sequence, to satisfy a predetermined relationship, which depends upon the distance from a nozzle of interest to the printing medium. This enables a variation in distance between the hitting position of the first ink droplet and the hitting position of the second ink droplet when the first driving pulse and the second driving pulse are respectively output to the adjoining pixels in this sequence and in the inverted sequence to be within a preset value.

In the first printer of the present invention, even if the waveform of the driving signal is changed from a first driving waveform to a second driving waveform, the distance between the hitting positions of the first ink droplet and the second ink droplet ejected in the two pixels adjoining to each other in the main scanning direction is kept to a substantially fixed value. This arrangement accordingly enables the positional relationship between two dots created by the first ink droplet and the second ink droplet to be kept in a substantially fixed state, irrespective of the waveform of the driving signal. This ensures the faithful reproduction of print data of interest and thereby effectively prevents deterioration of the picture quality of the resulting printed image.

In accordance with one preferable application of the first printer, the predetermined relationship adopted in the driving signal specification unit is expressed by an inequality given below:

$$Vc(\mathrm{T0}+PG/\mathrm{Vm2}-PG/\mathrm{Vm1})\leqq R/2$$

where Vm1 denotes the ejecting speed of the first ink droplet towards the printing medium, Vm2 denotes the ejecting speed of the second ink droplet towards the printing medium, T0 denotes the variation in time difference between the first driving pulse and the second driving pulse when the first driving pulse and the second driving pulse are respectively output to the adjoining pixels in this sequence and in the inverted sequence, Vc denotes a moving speed of the print head, PG denotes the distance from the nozzle of interest to the printing medium, and R denotes a size of one dot that depends upon a printing resolution.

This arrangement enables the distance between the hitting positions of the first ink droplet and the second ink droplet recorded in one pixel to be within half the size of one dot that depends upon the printing resolution.

In accordance with another preferable application of the first printer, the predetermined relationship adopted in the driving signal specification unit is expressed by an equation given below:

$$1/\mathrm{Vm1}-1/\mathrm{Vm2}=\mathrm{T0}/PG$$

where Vm1 denotes the ejecting speed of the first ink droplet towards the printing medium, Vm2 denotes the ejecting speed of the second ink droplet towards the printing medium, T0 denotes the variation in time difference between the first driving pulse and the second driving pulse when the first driving pulse and the second driving pulse are respectively output to the adjoining pixels in this sequence and in the inverted sequence, and PG denotes the distance from the nozzle of interest to the printing medium.

This arrangement enables the distance between the hitting positions of the first ink droplet and the second ink droplet recorded in one pixel to be substantially equal to zero.

In accordance with one preferable embodiment of the first printer, the driving signal specification unit includes a control quantity regulation unit that regulates a control quantity, in which only the variation in time difference is variable among the three factors, so as to specify the first driving pulse and the second driving pulse.

In accordance with another preferable embodiment of the first printer, the driving signal specification unit includes a control quantity regulation unit that regulates a control quantity, in which only the ejecting speed of the first ink droplet towards the printing medium and the ejecting speed of the second ink droplet towards the printing medium are variable among the three factors, so as to specify the first driving pulse and the second driving pulse.

These arrangements restrict the control quantity regulated by the driving signal specification unit and thereby facilitate the control procedure.

In accordance with one preferable application of the first printer, the print head generates a fine satellite particle in the process of separating a main particle for creating each ink droplet from a flow of ink jet, and ejects both the main particle and the satellite particle. The distance between the hitting position of the first ink droplet and the hitting position of the second ink droplet regulated by the driving signal specification unit is calculated on the assumption that the hitting position of each ink droplet is in the middle of a hitting position of the main particle and a hitting position of the satellite particle.

This arrangement enables the technique of the first printer to be applied for the case in which an ink droplet ejected from the nozzle on the print head is divided into the main particle and the satellite particle.

In accordance with another preferable application of the first printer, the driving signal generating unit generates the driving signal that selectively includes at least three driving pulses, which respectively cause at least three ink droplets to be ejected from each of the nozzles, in one printing period corresponding to one pixel in printing. The driving signal specification unit applies the technique of specification of the first driving pulse and the second driving pulse for a combination of ejection of two ink droplets, which are selected among ejection of the at least three ink droplets in response to the at least three driving pulses, in order to maximize a variation in distance between hitting positions of the two selected ink droplets when the two selected ink droplets are ejected in a certain sequence and in an inverted sequence.

In this arrangement, printing is carried out in response to a driving signal, which may selectively include three or more driving pulses in one printing period corresponding to one pixel in printing. This enables ejection of three or more different types of ink droplets in the area of one pixel. Combination of these ink droplets ensures at least 2×2×2=8 reproducible tones. This arrangement also reduces the variation in distance between the hitting positions of the two selected ink droplets, with regard to the combination of two ink droplets that has a maximum variation in distance when the two selected ink droplets are ejected in the certain sequence and in the inverted sequence. In the structure that enables each pixel to be recorded with three or more ink droplets, this arrangement thus effectively prevents deterioration of the picture quality of the resulting printed image.

The present invention is also directed to a second printer that prints an image on a printing medium while carrying out a main scan that moves a print head relative to the printing medium. The second printer includes: the print head that has a plurality of nozzles and a plurality of pressure generating elements, which respectively correspond to the plurality of nozzles, each of the pressure generating elements being driven in response to a driving signal, so as to cause an ink droplet to be ejected from the corresponding nozzle against the printing medium; a head driving control unit that generates the driving signal generates the driving signal that selectively includes a first driving pulse and a second driving pulse in one printing period corresponding to one pixel in printing, a first driving pulse causing a first ink droplet to be ejected from each of the nozzles, a second driving pulse following the first driving pulse and causing a second ink droplet to be ejected from each of the nozzles, and outputs the driving signal to the print head, thereby causing the print head to print an image on the printing medium; and a platen gap specification unit that specifies a distance from a nozzle of interest to the printing medium, in order to cause three factors, that is, an ejecting speed of the first ink droplet towards the printing medium, an ejecting speed of the second ink droplet towards the printing medium, and a variation in time difference between the first driving pulse and the second driving pulse when the first driving pulse and the second driving pulse are respectively output to adjoining pixels in this sequence and in an inverted sequence, to satisfy a predetermined relationship, which depends upon the distance from the nozzle of interest to the printing medium, thereby causing a variation in distance between a hitting position of the first ink droplet and a hitting position of the second ink droplet when the first driving pulse and the second driving pulse are respectively output to the adjoining pixels in this sequence and in the inverted sequence to be within a preset value.

The second printer of the above configuration specifies the distance from the nozzle of interest to the printing medium and accordingly exerts the similar effects to those of the first printer discussed above.

In accordance with one preferable application of the second printer, the print head generates a fine satellite particle in the process of separating a main particle for creating each ink droplet from a flow of ink jet, and ejects both the main particle and the satellite particle. The distance between the hitting position of the first ink droplet and the hitting position of the second ink droplet regulated by the platen gap specification unit is calculated on the assumption that the hitting position of each ink droplet is in the middle of a hitting position of the main particle and a hitting position of the satellite particle.

This arrangement enables the technique of the second printer to be applied for the case in which an ink droplet ejected from the nozzle on the print head is divided into the main particle and the satellite particle.

In accordance with another preferable application of the second printer, the head driving control unit generates the driving signal that selectively includes at least three driving pulses, which respectively cause at least three ink droplets to be ejected from each of the nozzles, in one printing period corresponding to one pixel in printing. The platen gap specification unit applies the technique of specification of the distance from the nozzle of interest to the printing medium for a combination of ejection of two ink droplets, which are selected among ejection of the at least three ink droplets in response to the at least three driving pulses, in order to maximize a variation in distance between hitting positions of the two selected ink droplets when the two selected ink droplets are ejected in a certain sequence and in an inverted sequence.

This arrangement enables the technique of the second printer to be applied for the case in which one pixel is recorded with three or more ink droplets.

The present invention is further directed to a first method of printing an image on a printing medium while carrying out a main scan that moves a print head relative to the printing medium, wherein the print head has a plurality of nozzles and a plurality of pressure generating elements, which respectively correspond to the plurality of nozzles, each of the pressure generating elements being driven in response to a driving signal, so as to cause an ink droplet to be ejected from the corresponding nozzle against the printing medium. The first method includes the step of: (a) controlling the driving signal output to the print head and thereby causing the print head to print an image on the printing medium. The step (a) includes the steps of: (a1) generating the driving signal that selectively includes a first driving pulse and a second driving pulse in one printing period corresponding to one pixel in printing, a first driving pulse causing a first ink droplet to be ejected from each of the nozzles, a second driving pulse following the first driving pulse and causing a second ink droplet to be ejected from each of the nozzles; and (a2) specifying the first driving pulse and the second driving pulse, in order to cause three factors, that is, an ejecting speed of the first ink droplet towards the printing medium, an ejecting speed of the second ink droplet towards the printing medium, and a variation in time difference between the first driving pulse and the second driving pulse when the first driving pulse and the second driving pulse are respectively output to adjoining pixels in this sequence and in an inverted sequence, to satisfy a predetermined relationship, which depends upon a distance from a nozzle of interest to the printing medium, thereby causing a variation in distance between a hitting position of the first ink droplet and a hitting position of the second ink droplet when the first driving pulse and the second driving pulse are respectively output to the adjoining pixels in this sequence and in the inverted sequence to be within a preset value.

Like the first printer discussed above, the first method enables the positional relationship between two dots created by the first ink droplet and the second ink droplet to be kept in a substantially fixed state, irrespective of the waveform of the driving signal. This ensures the faithful reproduction of print data of interest and thereby effectively prevents deterioration of the picture quality of the resulting printed image.

In accordance with one preferable application of the first method, the predetermined relationship adopted in the step (a2) is expressed by an inequality given below:

$$Vc(T0+PG/Vm2-PG/Vm1)\leqq R/2$$

where Vm1 denotes the ejecting speed of the first ink droplet towards the printing medium, Vm2 denotes the ejecting speed of the second ink droplet towards the printing medium, T0 denotes the variation in time difference between the first driving pulse and the second driving pulse when the first driving pulse and the second driving pulse are respectively output to the adjoining pixels in this sequence and in the inverted sequence, Vc denotes a moving speed of the print head, PG denotes the distance from the nozzle of interest to the printing medium, and R denotes a size of one dot that depends upon a printing resolution.

In accordance with another preferable application of the first method, the predetermined relationship adopted in the step (a2) is expressed by an equation given below:

$$1/Vm1-1/Vm2=T0/PG$$

where Vm1 denotes the ejecting speed of the first ink droplet towards the printing medium, Vm2 denotes the ejecting speed of the second ink droplet towards the printing medium, T0 denotes the variation in time difference between the first driving pulse and the second driving pulse when the first driving pulse and the second driving pulse are respectively output to the adjoining pixels in this sequence and in the inverted sequence, and PG denotes the distance from the nozzle of interest to the printing medium.

In accordance with one favorable embodiment of the first method, the step (a2) includes the step of regulating a control quantity, in which only the variation in time difference is variable among the three factors, so as to specify the first driving pulse and the second driving pulse.

In accordance with another preferable embodiment of the first method, the step (a2) includes the step of regulating a control quantity, in which only the ejecting speed of the first ink droplet towards the printing medium and the ejecting speed of the second ink droplet towards the printing medium are variable among the three factors, so as to specify the first driving pulse and the second driving pulse.

In accordance with one preferable application of the first method, the print head generates a fine satellite particle in the process of separating a main particle for creating each ink droplet from a flow of ink jet, and ejects both the main particle and the satellite particle. The distance between the hitting position of the first ink droplet and the hitting position of the second ink droplet regulated in the step (a2) is calculated on the assumption that the hitting position of each ink droplet is in the middle of a hitting position of the main particle and a hitting position of the satellite particle.

In accordance with another preferable application of the first method, the step (a1) includes the step of generating the driving signal that selectively includes at least three driving pulses, which respectively cause at least three ink droplets to be ejected from each of the nozzles, in one printing period corresponding to one pixel in printing. The step (a2) includes the step of applying the technique of specification of the first driving pulse and the second driving pulse for a combination of ejection of two ink droplets, which are selected among ejection of the at least three ink droplets in response to the at least three driving pulses, in order to maximize a variation in distance between hitting positions of the two selected ink droplets when the two selected ink droplets are ejected in a certain sequence and in an inverted sequence.

The present invention is also directed to a second method of printing an image on a printing medium while carrying out a main scan that moves a print head relative to the printing medium, wherein the print head has a plurality of nozzles and a plurality of pressure generating elements, which respectively correspond to the plurality of nozzles, each of the pressure generating elements being driven in response to a driving signal, so as to cause an ink droplet to be ejected from the corresponding nozzle against the printing medium. The second method includes the steps of: (a) generating the driving signal that selectively includes a first driving pulse and a second driving pulse in one printing period corresponding to one pixel in printing, a first driving pulse causing a first ink droplet to be ejected from each of the nozzles, a second driving pulse following the first driving pulse and causing a second ink droplet to be ejected from each of the nozzles, and outputting the driving signal to the print head, thereby causing the print head to print an image on the printing medium; and (b) specifying a distance from a nozzle of interest to the printing medium, in order to cause three factors, that is, an ejecting speed of the first ink droplet towards the printing medium, an ejecting speed of the second ink droplet towards the printing medium, and a variation in time difference between the first driving pulse and the second driving pulse when the first driving pulse and the second driving pulse are respectively output to adjoining pixels in this sequence and in an inverted sequence, to satisfy a predetermined relationship, which depends upon the distance from the nozzle of interest to the printing medium, thereby causing a variation in distance between a hitting position of the first ink droplet and a hitting position of the second ink droplet when the first driving pulse and the second driving pulse are respectively output to the adjoining pixels in this sequence and in the inverted sequence to be within a preset value.

Like the second printer discussed above, the second method enables the positional relationship between two dots created by the first ink droplet and the second ink droplet to be kept in a substantially fixed state, irrespective of the waveform of the driving signal. This ensures the faithful reproduction of print data of interest and thereby effectively prevents deterioration of the picture quality of the resulting printed image.

In accordance with one preferable application of the second method, the print head generates a fine satellite particle in the process of separating a main particle for creating each ink droplet from a flow of ink jet, and ejects both the main particle and the satellite particle. The distance between the hitting position of the first ink droplet and the hitting position of the second ink droplet regulated in the step (b) is calculated on the assumption that the hitting position of each ink droplet is in the middle of a hitting position of the main particle and a hitting position of the satellite particle.

In accordance with another preferable application of the second method, the step (a) includes the step of generating the driving signal that selectively includes at least three driving pulses, which respectively cause at least three ink droplets to be ejected from each of the nozzles, in one printing period corresponding to one pixel in printing. The step (b) includes the step of applying the technique of specification of the distance from the nozzle of interest to the printing medium for a combination of ejection of two ink droplets, which are selected among ejection of the at least three ink droplets in response to the at least three driving pulses, in order to maximize a variation in distance between hitting positions of the two selected ink droplets when the two selected ink droplets are ejected in a certain sequence and in an inverted sequence.

The present invention may be actualized by a variety of other possible applications. A first application is a computer program that causes a computer to attain the functions of the head driving control unit included in the first printer or the functions of the head driving control unit and the platen gap specification unit included in the second printer discussed above. A second application is a computer readable recording medium, in which the computer program is recorded. A third application is a program supply apparatus that supplies the computer program to the computer via a communication path. Any of the above printers and the methods may be attained by downloading a required program stored in a server on a network to the computer via the communication path and causing the computer to execute the program.

These and other objects, features, aspects, and advantages of the present invention will become more apparent from the following detailed description of the preferred embodiment with the accompanying drawings.

DESCRIPTION OF THE PREFERRED EMBODIMENTS

A. Structure of Printing System

Figure 1:
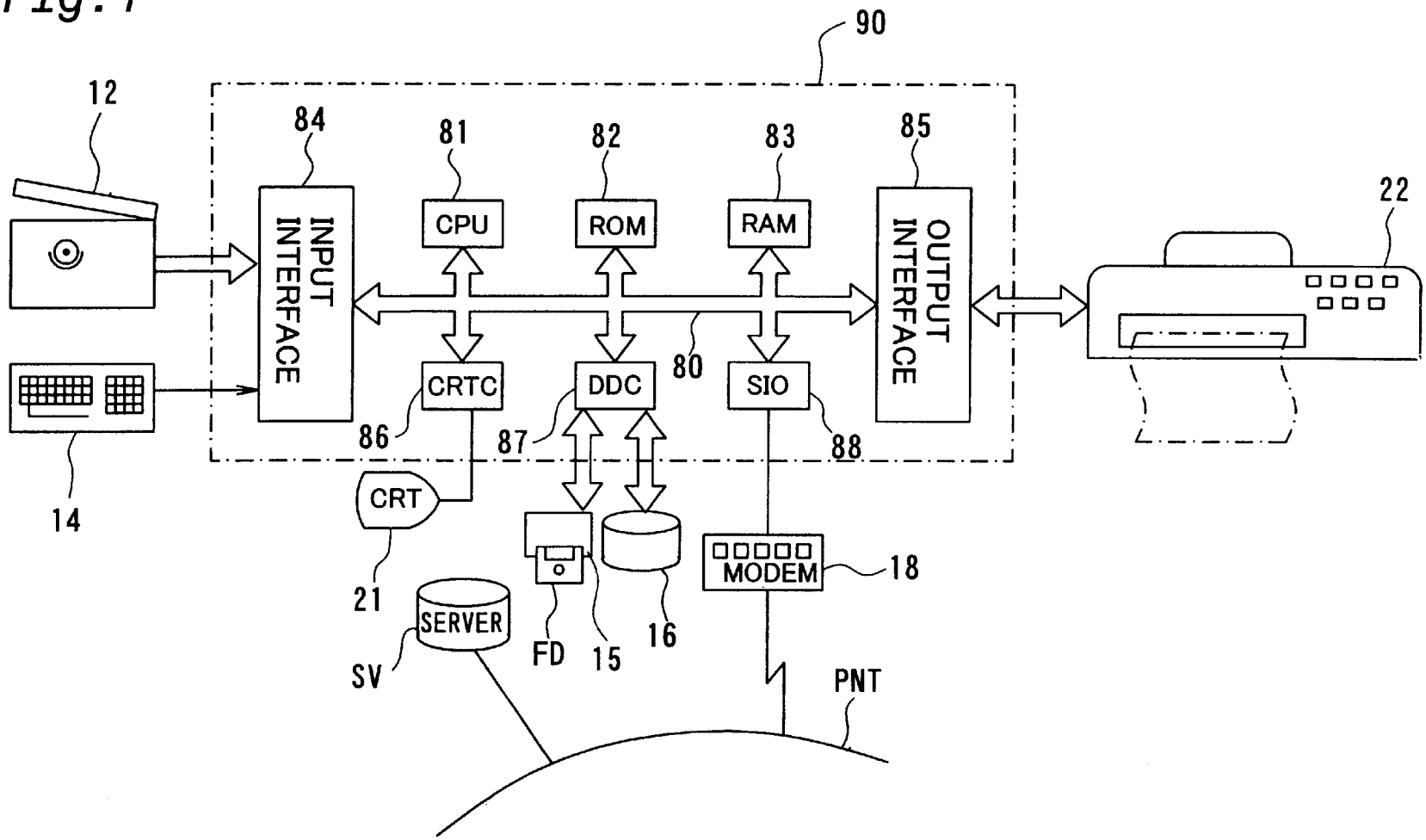
FIG. 1 is a block diagram schematically illustrating the structure of a printing system that includes a printer 22 embodying the present invention.

FIG. 1 is a block diagram schematically illustrating the structure of a printing system that includes a printer embodying the present invention. The printing system includes a computer 90 connected to a scanner 12 and a color printer 22. The computer 90 reads and executes predetermined programs to attain the functions of the printing system. The computer 90 has a CPU 81, which executes a variety of operations for controlling processes relating to image processing according to the programs, and other constituents that are mutually connected via a bus 80 and discussed below.

A ROM 82 stores in advance a variety of programs and data required for the execution of the various operations by the CPU 81. A variety of programs and data required for the execution of the various operations by the CPU 81 are temporarily written in and read from a RAM 83. An input interface 84 is in charge of input of signals from the scanner 12 and a keyboard 14, whereas an output interface 85 is in charge of output of data to the printer 22. CRTC 86 controls output of signals to a color CRT display 21. A disk controller (DDC) 87 controls transmission of data to and from a hard disk 16, a flexible disk drive 15, and a CD-ROM drive (not shown). A variety of programs loaded to the RAM 83 and executed as well as a variety of other programs provided in the form of a device driver are stored in the hard disk 16.

A serial input-output interface (SIO) 88 is also connected to the bus 80. The SIO 88 is connected to a modem 18 and further to a public telephone network PNT via the modem 18. The computer 90 is connected with an external network via the SIO 88 and the model 18 and may gain access to a specific server SV to download the programs required for the image processing into the hard disk 16. Another possible application reads the required programs from a flexible disk FD or a CD-ROM and causes the computer 90 to execute the input programs.

Figure 2:
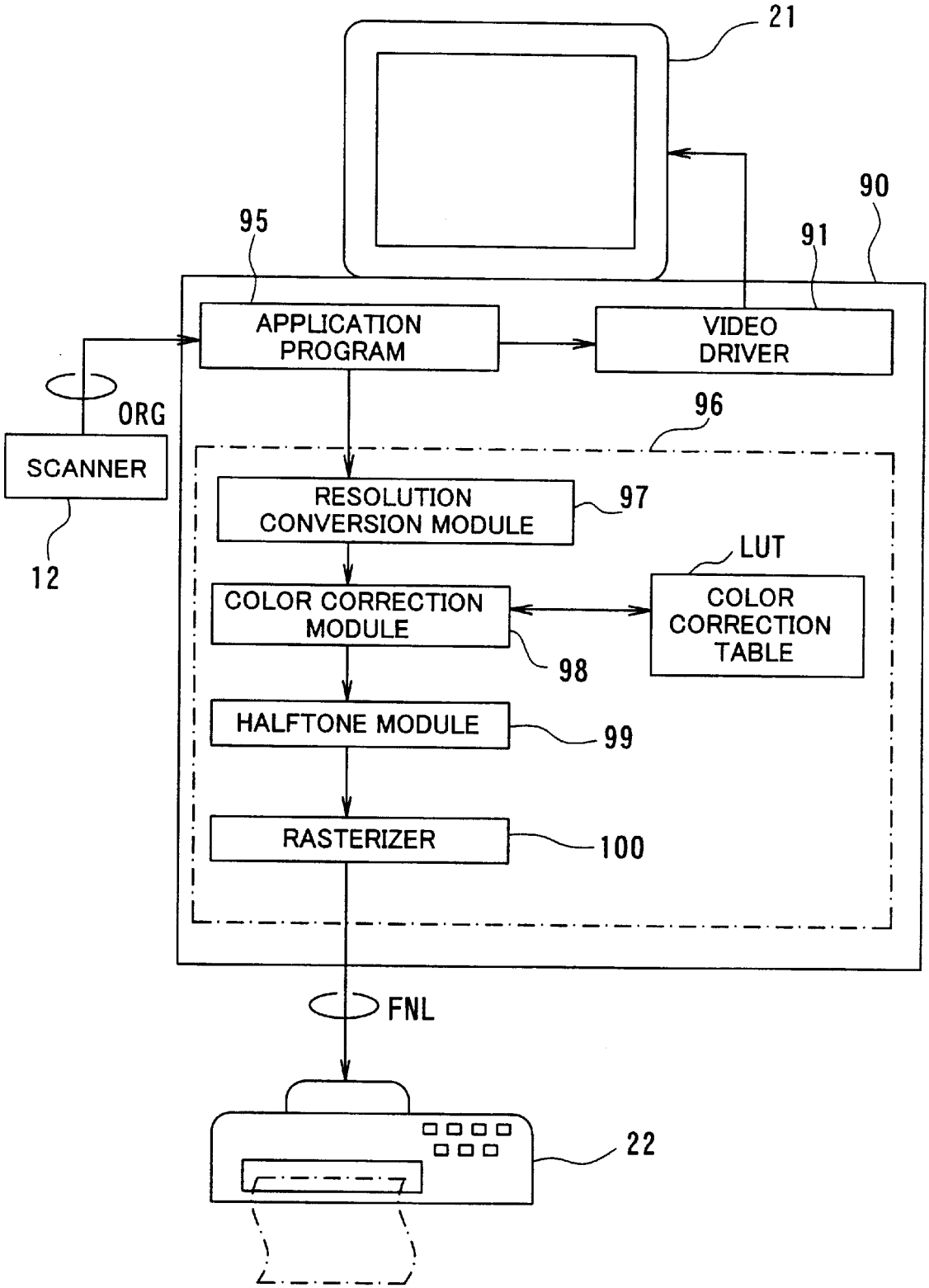
FIG. 2 is a block diagram illustrating a software configuration of the printing system.

FIG. 2 is a block diagram illustrating a software configuration of the printing system. The computer 90 executes an application program 95 under a specific operating system. A video driver 91 and a printer driver 96 are incorporated in the operating system. Intermediate image data MID are output from the application program 95 to be transferred to the printer 22 via the printer driver 96. The application program 95, which implements required image processing, such as retouching of images, reads an image from the scanner 12, causes the input image to be subjected to the required image processing, and displays the processed image on the CRT display 21 via the video driver 91. The scanner 12 reads color image data from a color original and outputs the color image data as original color image data ORG, which consists of three color components, red (R), green (G), and blue (B), to the application program 95.

When the application program 95 issues an instruction of printing, the printer driver 96 in the computer 90 receives image information from the application program 95 and converts the input image information into signals processible by the printer 22 (in this embodiment, multi-value signals with respect to four colors, cyan, magenta, yellow, and black). In the example of FIG. 2, the printer driver 96 includes a resolution conversion module 97, a color correction module 98, a color correction table LUT, a halftone module 99, and a rasterizer 100.

The resolution conversion module 97 converts the resolution of the color image data processed by the application program 95, that is, the number of pixels per unit length, into the resolution processible by the printer driver 96. The image data with the converted resolution are still image information consisting of three color components, R, G, and B. The color correction module 98 refers to the color correction table LUT and further converts the resolution-converted image data with respect to each pixel into color data regarding the respective colors, cyan (C), magenta (M), yellow (Y), and black (K), that are printable by the printer 22. The color-corrected data have tone values, for example, in the range of 256 tones. The halftone module 99 carries out a halftone process to create dots in a dispersed manner and enables the expression of the specified tone values by the printer 22. The printer 22 of this embodiment is a three-value printer that enables expression of three values, that is, no creation of dot, creation of a small dot, and creation of a large dot, with respect to each pixel as described later. The processed image data are rearranged by the rasterizer 100 to a sequence of data to be transferred to the printer 22 and output as final image data FNL. In this embodiment, the printer 22 only plays a role of creating dots based on the image data FNL and does not carry out the image processing. The printer driver 96 included in the computer 90 does not regulate a piezoelectric element driving signal (discussed later) in the printer 22. In accordance with an alternative application, the printer driver 96 may set a plurality of pulse signals included in the piezoelectric element driving signal by taking advantage of the function of bidirectional communication.

B. Structure of Printer

Figure 3:
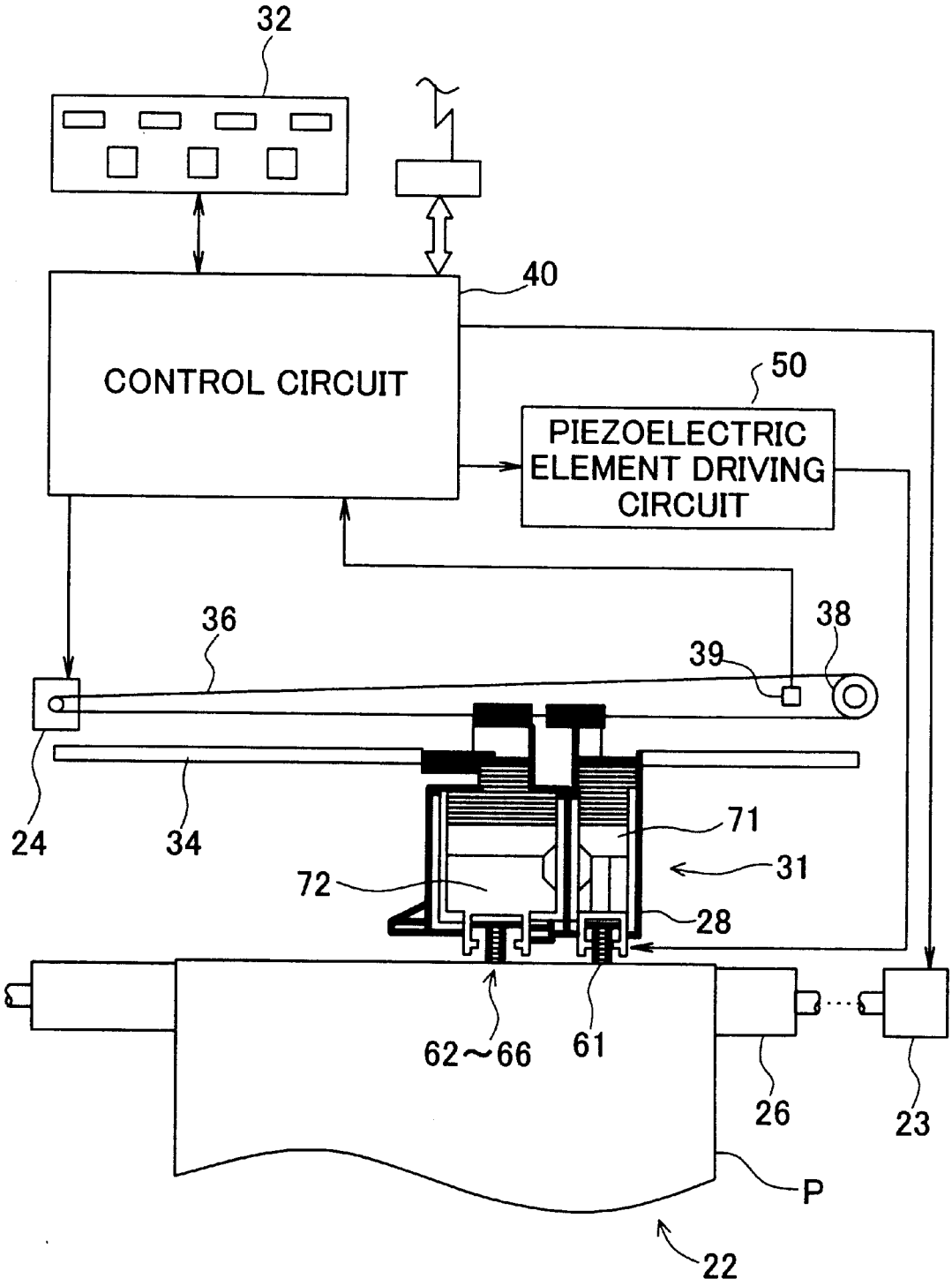
FIG. 3 schematically illustrates the internal structure of the printer 22.

The schematic structure of the printer 22 used in this embodiment is described with the drawing of FIG. 3. As illustrated in FIG. 3, the printer 22 has a mechanism for causing a sheet feed motor 23 to feed a sheet of printing paper P, a mechanism for causing a carriage motor 24 to move a carriage 31 forward and backward along an axis of a platen 26, a mechanism for driving a print head 28 mounted on the carriage 31 to control the ejection of ink and creation of dots, a control circuit 40 that controls transmission of signals to and from the sheet feed motor 23, the carriage motor 24, the print head 28, and a control panel 32, and a piezoelectric element driving circuit 50 that receives signals from the control circuit 40 and generates driving signals for driving piezoelectric elements.

The mechanism for reciprocating the carriage 31 along the axis of the platen 26 includes a sliding shaft 34 arranged in parallel with the axis of the platen 26 for slidably supporting the carriage 31, a pulley 38, an endless drive belt 36 spanned between the carriage motor 24 and the pulley 38, and a position sensor 39 that detects the position of the origin of the carriage 31.

A black ink cartridge 71 for black ink (Bk) and a color ink cartridge 72 in which five color inks, that is, cyan (C1), light cyan (C2), magenta (M1), light magenta (M2), and yellow (Y), are accommodated may be mounted on the carriage 31 of the printer 22. Both the higher-density ink and the lower-density ink are provided for the two colors, cyan and magenta. A total of six ink ejection heads 61 through 66 are formed on the print head 28 that is disposed in the lower portion of the carriage 31, and ink supply conduits 67 (see FIG. 6) are arranged upright in the bottom portion of the carriage 31 for leading supplies of inks from ink tanks to the respective ink ejection heads 61 through 66. When the black ink cartridge 71 and the color ink cartridge 72 are attached downward to the carriage 31, the ink supply conduits 67 are inserted into connection apertures (not shown) formed in the respective ink cartridges 71 and 72. This enables supplies of inks to be fed from the respective ink cartridges 71 and 72 to the ink ejection heads 61 through 66.

Figure 4:
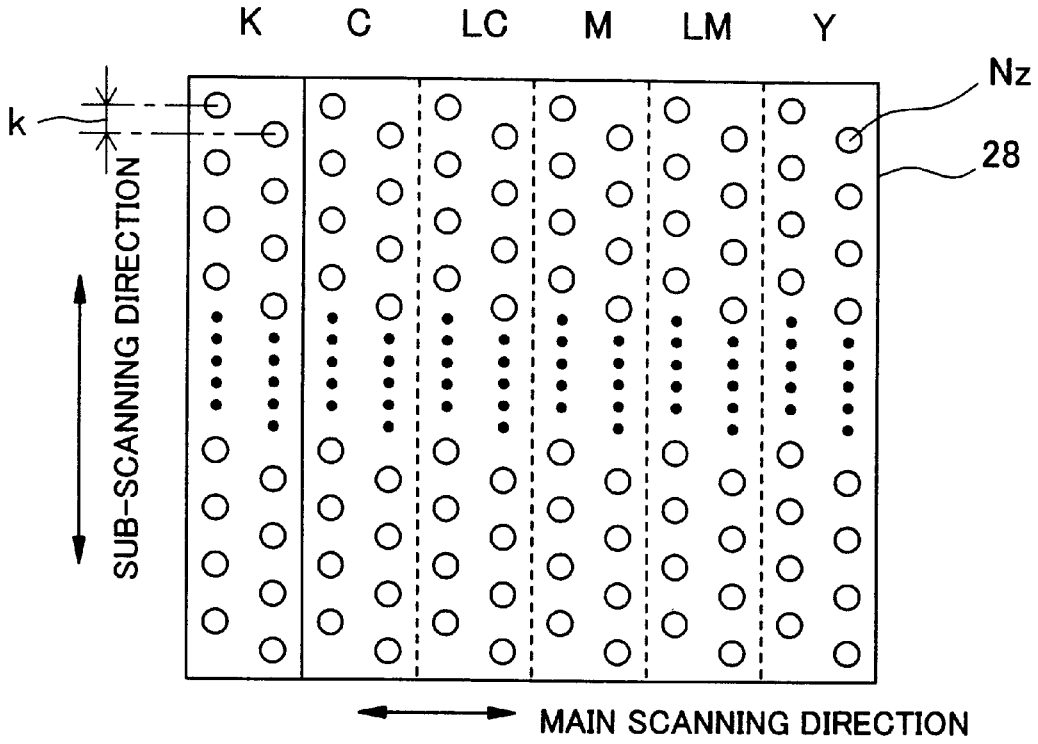
FIG. 4 shows an arrangement of nozzles on a print head 28 in the printer 22.

FIG. 4 shows an arrangement of ink jet nozzles Nz in each of the ink ejection heads 61 through 66. The arrangement of nozzles shown in FIG. 4 includes six nozzle arrays, wherein each nozzle array ejects ink of each color and includes forty-eight nozzles Nz arranged in zigzag at a fixed nozzle pitch k. The positions of the nozzles in the sub-scanning direction are identical in the respective nozzle arrays. The forty-eight nozzles Nz included in each nozzle array may be arranged in alignment, instead of in zigzag. The zigzag arrangement shown in FIG. 4, however, allows a small value to be set to the nozzle pitch k in the manufacturing process.

Figure 5:
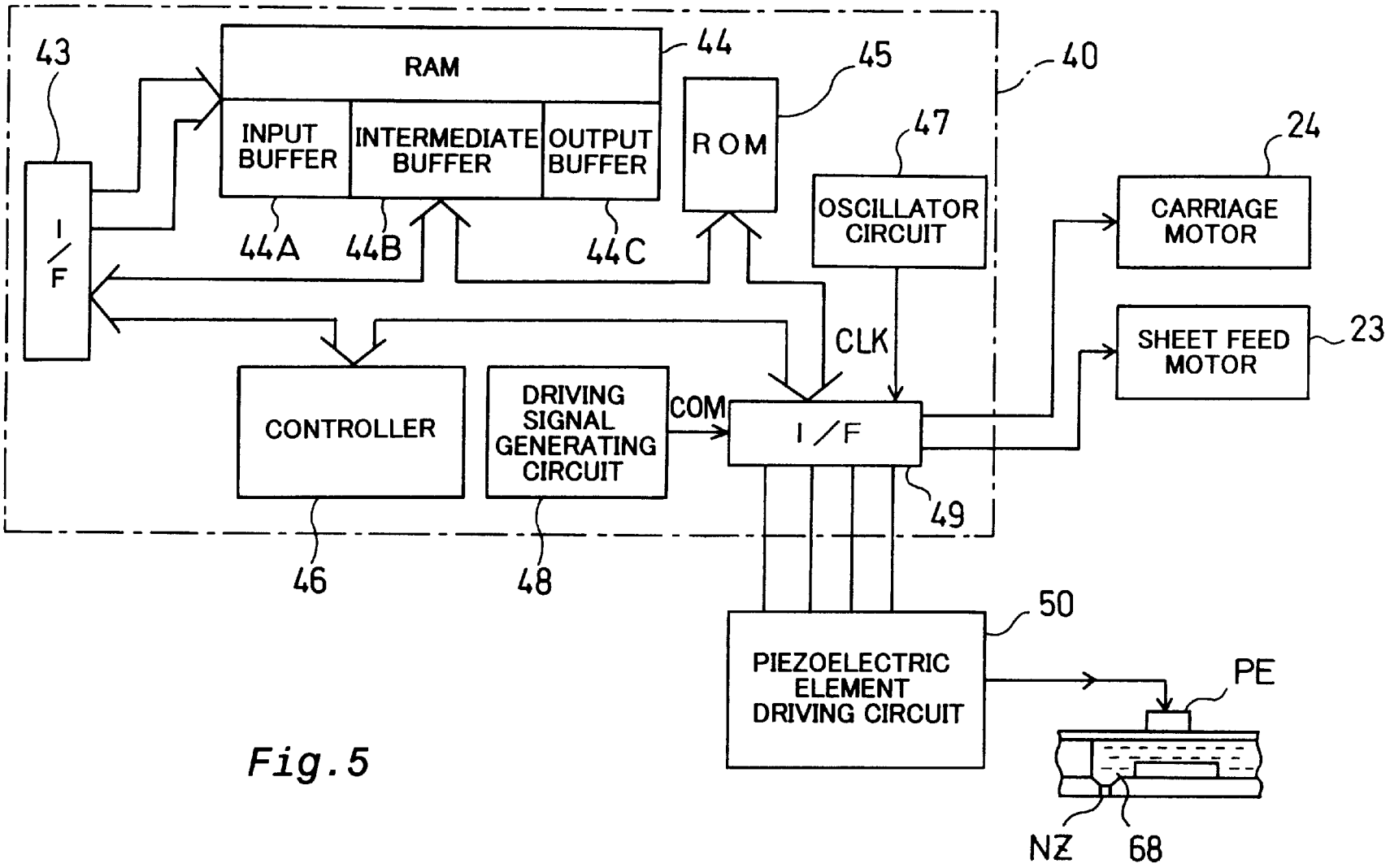
FIG. 5 is a block diagram illustrating the electrical configuration of the printer 22.

The ejection of ink from the nozzles Nz is regulated by the control circuit 40 and the piezoelectric element driving circuit 50. FIG. 5 shows the internal structure of the control circuit 40. The control circuit 40 includes an interface (hereinafter referred to as I/F) 43 that receives print data, which are output from the computer 90 and include multi-value tone information, a RAM 44 in which a variety of data are stored, a ROM 45 in which computer programs for a variety of data processing operations are stored, a controller 46 including a CPU that executes the data processing according to the computer programs, an oscillator circuit 47, a driving signal generating circuit 48 for generating a driving signal COM transmitted to piezoelectric elements (discussed later) in the print head 28, and an I/F 49 that transmits print data, which are expanded to dot pattern data, and driving signals to the sheet feed motor 23, the carriage motor 24, and the piezoelectric element driving circuit 50.

The programs may be stored in the RAM 44 in place of the ROM 45. The programs are recorded in advance in a recording medium, such as a flexible disk FD and a CD-ROM, and are transferred from the recording medium to the RAM 44. The programs may alternatively be supplied from an apparatus connected to a network (not shown) via a communication path.

In this embodiment, the computer 90 transmits the print data, which have been subjected to the three-value processing carried out by the printer driver 96, to the control circuit 40 in the printer 22. The control circuit 40 subsequently registers the transmitted print data in an input buffer 44A, expands the print data in an output buffer 44C according to the arrangement of the nozzle arrays on the print head 28, and outputs the expanded data via the I/F 49. In the case where the computer 90 transmits the print data including multi-value tone information (for example, the data in a PostScript format), on the other hand, the control circuit 40 in the printer 22 is required to carry out the three-value processing. In this case, the transmitted print data are registered into the input buffer 44A via the I/F 43, subjected to a command analysis, and sent to an intermediate buffer 44B. The print data are converted into intermediate codes by the controller 46 and registered in the intermediate format into the intermediate buffer 44B. The controller 46 specifies the printing positions of the respective letters or characters, the types of decoration, the letter sizes, and the font addresses. The controller 46 then analyzes the print data registered in the intermediate buffer 44B, carries out the three-value processing according to the tone information, and stores the expanded dot pattern data into the output buffer 44C.

In either case, the three-valued dot pattern data are expanded and stored in the output buffer 44C. The print head 28 has forty-eight nozzles with respect to each color as described previously. The dot pattern data corresponding to one scan of the print head 28 is provided in the output buffer 44C and subsequently output via the I/F 49. The print data expanded to the dot pattern data are, for example, 2-bit tone data with regard to the respective nozzles as described later. In this example, the value '00' corresponds to no creation of dot, '10' corresponds to creation of a small dot, '01' corresponds to creation of a medium dot, and '11' corresponds to creation of a large dot. The details of the data structure and the dot creation procedure will be discussed later.

C. Mechanism of Ink Ejection

Figure 6:
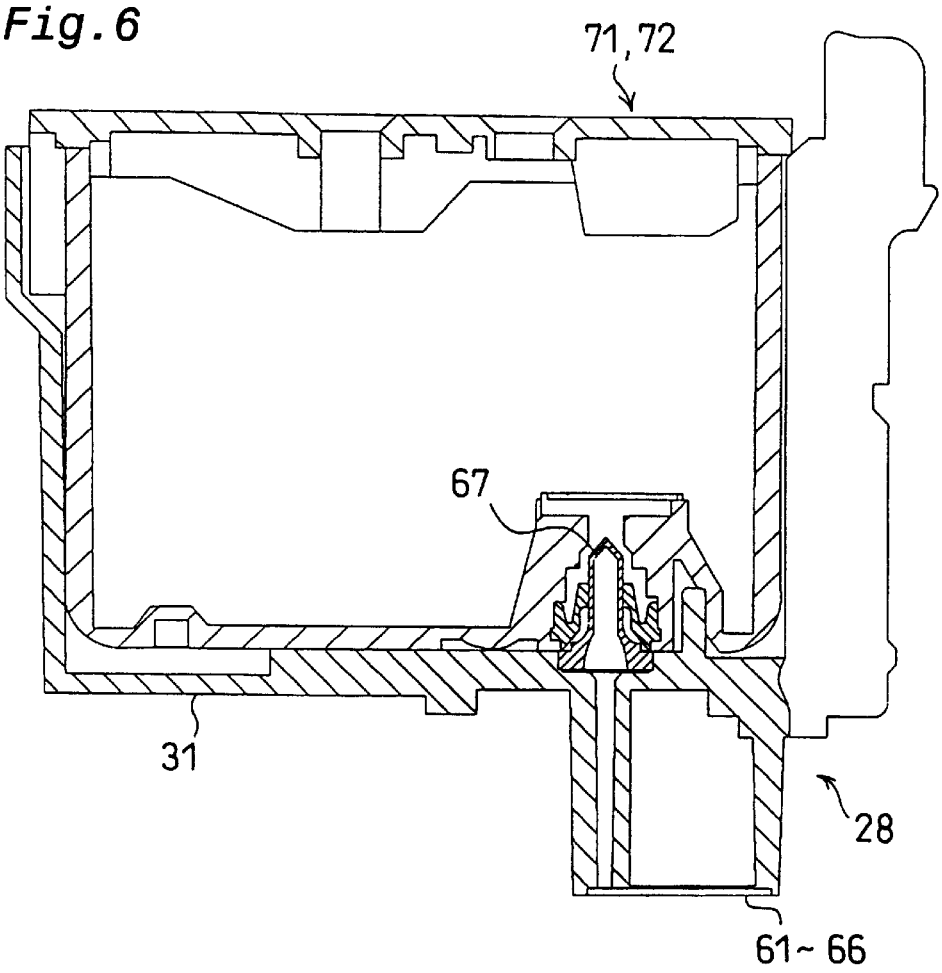
FIG. 6 schematically illustrates the structure of the print head 28 with an ink supply conduit.
Figure 7:
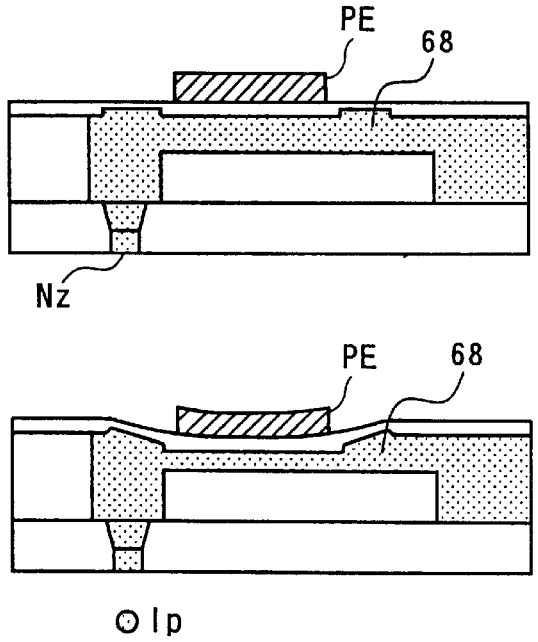
FIG. 7 shows the principle of ejecting an ink droplet by extension and contraction of a piezoelectric element.

The following describes the mechanism of ejecting ink and creating dots. FIG. 6 schematically illustrates the internal structure of the print head 28, and FIGS. 7 show the principle of ink ejection by contraction and extension of a piezoelectric element PE. When the ink cartridges 71 and 72 are attached to the carriage 31, supplies of inks in the ink cartridges 71 and 72 are sucked out by capillarity through the ink supply conduits 67 and are led to the ink ejection heads 61 through 66 formed in the print head 28 arranged in the lower portion of the carriage 31 as shown in FIG. 6. In the event that the ink cartridges 71 and 72 are attached to the carriage 31 for the first time, a pump works to suck first supplies of inks into the respective ink ejection heads 61 through 66. In this embodiment, the structure of the pump for suction and a cap for covering the print head 28 during the suction is not illustrated nor described specifically.

The array of forty-eight nozzles Nz for each color is provided in each of the ink ejection heads 61 through 66 as discussed previously. A piezoelectric element PE, which is one of electrically distorting elements and has an excellent response, is arranged for each nozzle Nz as the pressure generating element. As shown in the upper drawing of FIG. 7, the piezoelectric element PE is disposed at a position that comes into contact with an ink conduit 68 for leading ink to the nozzle Nz. As is known by those skilled in the art, the piezoelectric element PE has a crystal structure that is subjected to mechanical stress due to application of a voltage and thereby carries out extremely high-speed conversion of electrical energy into mechanical energy. In this embodiment, application of a voltage between electrodes on both ends of the piezoelectric element PE for a predetermined time period causes the piezoelectric element PE to extend for the predetermined time period and deform one side wall of the ink conduit 68 as shown in the lower drawing of FIG. 7. The volume of the ink conduit 68 is reduced with an extension of the piezoelectric element PE, and a certain amount of ink corresponding to the reduced volume is sprayed as an ink particle Ip from the end of the nozzle Nz at a high speed. The ink particles Ip soak into the sheet of paper P set on the platen 26, so as to implement printing.

Figure 8:
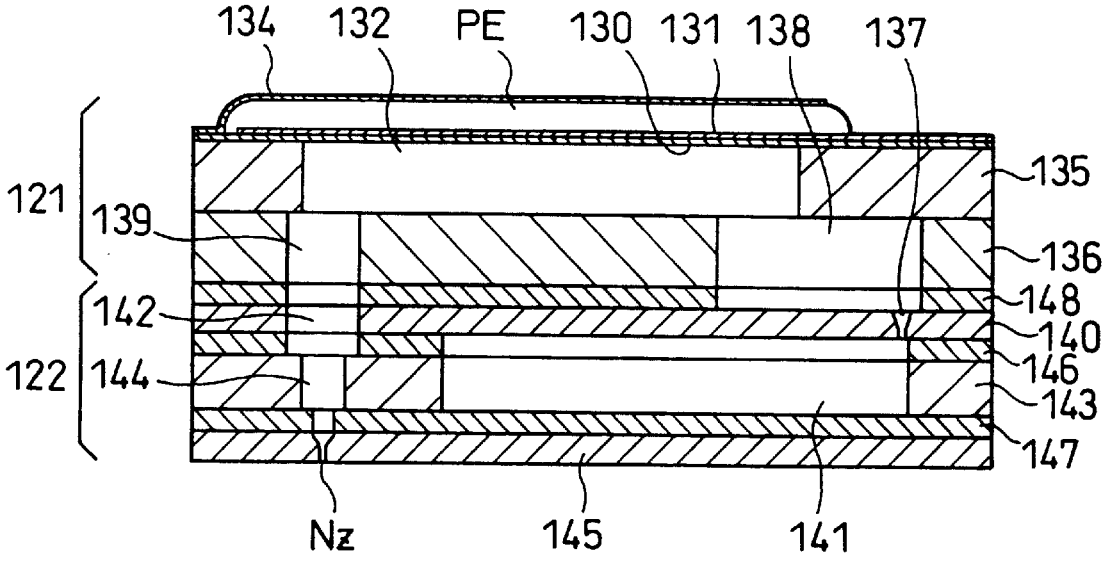
FIG. 8 is a sectional view illustrating the mechanical structure of the ink ejection mechanism provided in the print head 28.

The details of the mechanism for ejecting ink droplets with the piezoelectric element PE are described with the drawing of FIG. 8. FIG. 8 is a sectional view illustrating a mechanical structure of each of the ink ejection heads 61 through 66. Each of the ink ejection heads 61 through 66 mainly includes an actuator unit 121 and a flow path unit 122. The actuator unit 121 includes the piezoelectric element PE, a first cover member 130, a second cover member 136, and a spacer 135. The first cover member 130 is composed of a zirconia thin plate having the thickness of about 6 $\mu$m, and has a common electrode 131 formed on the surface thereof. The piezoelectric element PE is fixed to the surface of the common electrode 131 to be opposed to a pressure chamber 132 (discussed later). A drive electrode 134 composed of a relatively soft metal layer, such as an Au layer, is further formed on the surface of the piezoelectric element PE.

The piezoelectric element PE combines with the first cover member 130 to constitute an actuator of a deflective vibration type. The piezoelectric element PE extends under application of electric charges and deforms to reduce the volume of the pressure chamber 132. In response to discharge of the applied electric charges, the piezoelectric element PE contracts and deforms to expand back the volume of the pressure chamber 132.

The spacer 135 arranged below the first cover member 130 is a ceramic plate with a through hole, which is composed of, for example, zirconia ($ZrO_2$) and has a thickness suitable for defining the pressure chamber 132, for example, 100 $\mu$m. The spacer 135 is covered on the upper and lower ends thereof with the first cover member 130 and the second cover member 136 to define the pressure chamber 132.

The second cover member 136 fixed to the lower end of the spacer 135 is composed of a ceramic, such as zirconia, like the spacer 135. The second cover member 136 has two connection holes 138 and 139 that are connected with the pressure chamber 132 to define an ink flow pathway. The connection hole 138 connects an ink supply inlet 137 (described later) with the pressure chamber 132, whereas the connection hole 139 connects a nozzle opening Nz with the pressure chamber 132.

These constituents 130, 135, and 136 are integrated into the actuator unit 121 without using an adhesive but by forming a clay-like ceramic material into the respective constituents of predetermined shapes, laying the constituents one upon another to a laminate, and baking the laminate.

The flow path unit 122 includes an ink supply inlet-forming base plate 140, an ink chamber-forming base plate 143, and a nozzle plate 145. The ink supply inlet-forming base plate 140 also works as a support base of the actuator unit 121. The ink supply inlet 137 is arranged on one end of the pressure chamber 132, and the nozzle opening Nz is arranged on the other end of the pressure chamber 132. The ink: supply inlet 137 connects the pressure chamber 132 with an ink chamber 141 that is common to the respective nozzles. The ink supply inlet 137 has a sufficiently smaller cross section than that of the connection hole 138 and is designed to function as an orifice.

The ink chamber-forming base plate 143 is covered with the nozzle plate 145 and combined with the ink supply inlet-forming base plate 140 to define the ink chamber 141. The ink chamber-forming base plate 143 has a nozzle connection hole 144 that connects with the nozzle opening Nz. The ink chamber 141 is connected to ink flow paths (not shown) that are continuous with the ink cartridges 71 and 72, in order to receive supplies of inks from ink tanks (not shown).

The ink supply inlet-forming base plate 140, the ink chamber-forming base plate 143, and the nozzle plate 145 are laid one upon another and fixed to one another via adhesive layers 146 and 147, such as thermal welding films or adhesives, so as to jointly construct the flow path unit 122.

The flow path unit 122 and the actuator unit 121 are fixed to each other via an adhesive layer 148, such as a thermal welding film or an adhesive, so as to construct each of the ink election heads 61 through 66.

In the above structure, when a voltage is applied between the drive electrodes 131 and 134 of the piezoelectric element PE to supply electric charges, the piezoelectric element PE extends to reduce the volume of the pressure chamber 132. In response to discharge of the electric charges, on the contrary, the piezoelectric element PE contracts to increase the volume of the pressure chamber 132. The expansion of the pressure chamber 132 lowers the pressure in the pressure chamber 132 and causes a flow of ink to run from the common ink chamber 141 into the pressure chamber 132. When the electric charges are subsequently applied to the piezoelectric element PE, the volume of the pressure chamber 132 is reduced and the pressure in the pressure chamber 132 abruptly increases. The abrupt increase in pressure causes ink in the pressure chamber 132 to be ejected as the ink droplet Ip outside via the nozzle opening Nz.

D. Ejection of Large and Small Ink Droplets

Figure 9:
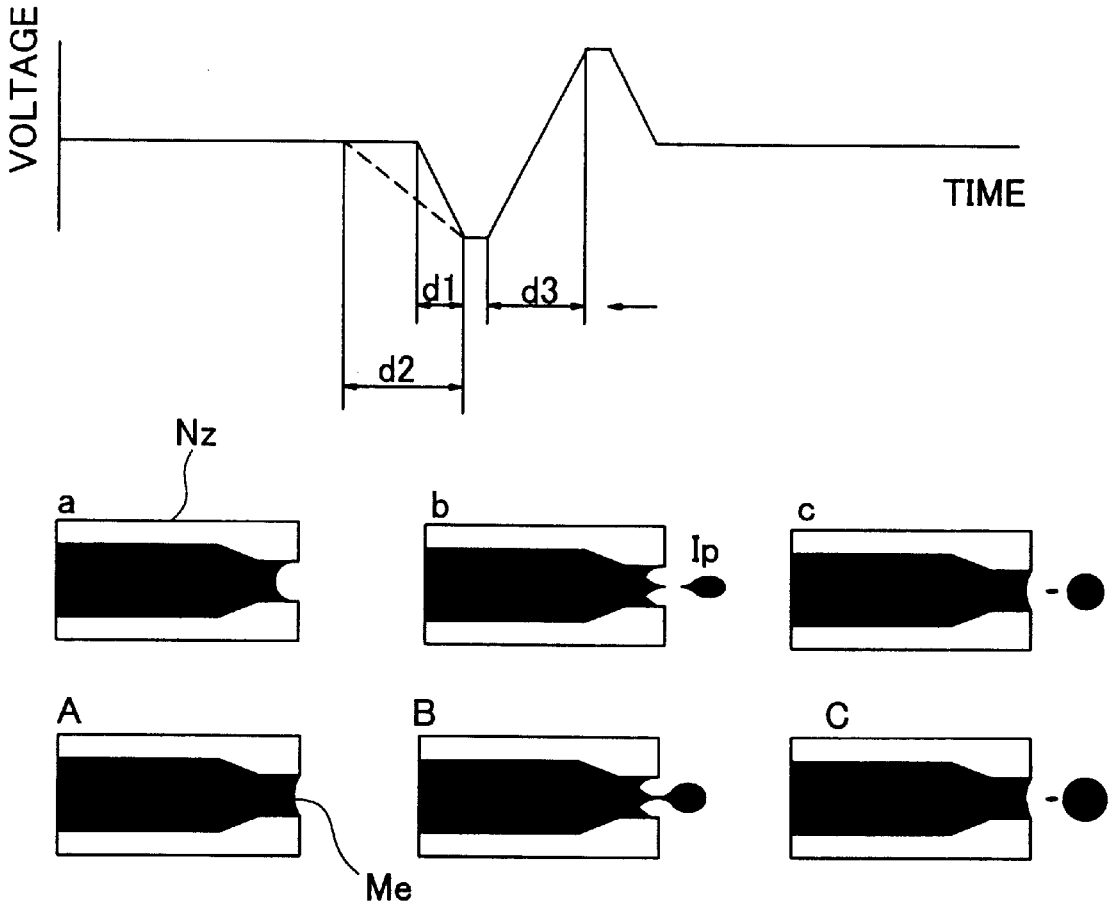
FIG. 9 shows the principle of ejecting ink droplets in response to driving signals supplied to the piezoelectric element.

The forty-eight nozzles Nz with regard to each color provided in the printer 22 of the embodiment have an identical bore. Two different types of dots having different diameters can be created with each of the nozzles Nz as discussed below. FIG. 9 shows the relationship between the driving waveform of the nozzle Nz and the size of the ink particle Ip ejected from the nozzle Nz. The driving waveform shown by the dotted line in FIG. 9 is used to create standard-sized dots. When the voltage applied to the piezoelectric element PE decreases from an intermediate potential to a lower potential in a division d2, the piezoelectric element PE deforms to increase the volume of the pressure chamber 132. As shown in a state A of FIG. 9, an ink interface Me, which is generally referred to as meniscus, is thus slightly concaved inward the nozzle Nz. When the driving waveform shown by the solid line in FIG. 9 is used to abruptly decrease the voltage from the intermediate potential to the lower potential in a division d1, on the other hand, the meniscus Me is more significantly concaved inward the nozzle Nz as shown in a state 'a', compared with the state A.

Because of the reason discussed below, the shape of the meniscus is varied by the pulse waveform of the voltage that is applied to the piezoelectric element PE and decreases from the intermediate potential to the lower potential. The piezoelectric element PE deforms according to the pulse waveform of the applied voltage and thereby varies the volume of the pressure chamber 132. In the event that the volume of the pressure chamber 132 increases by a gentle slope, the increase in volume of the pressure chamber 132 causes a supply of ink to be fed from the common ink chamber 141 and does not significantly change the meniscus Me. In the case where the piezoelectric element PE deforms in a short time period to change the volume of the pressure chamber 132 abruptly, on the other hand, the restriction of the ink supply inlet 137 causes an insufficient supply of ink from the ink chamber 141. The meniscus Me is thus significantly affected by the variation in volume of the pressure chamber 132. Such balance of ink supply causes the meniscus Me to be concaved inward slightly in the case of a gentle variation in voltage applied to the piezoelectric element PE (see the dotted line in the graph of FIG. 9) and, on the other hand, causes the meniscus Me to be concaved inward significantly in the case of an abrupt variation in applied voltage (see the solid line in the graph of FIG. 9)

In the state that the meniscus Me is concaved inward the nozzle Nz, a subsequent increase in voltage applied to the piezoelectric element PE in a division d3 causes the ink to be ejected, based on the principle described previously with the drawing of FIG. 7. As shown in states B and C, a large ink droplet (for creating a medium dot) is ejected when the meniscus Me is only slightly concaved inward (state A). As shown in states 'b' and 'c', on the other hand, a small ink droplet (for creating a small dot) is ejected when the meniscus Me is significantly concaved inward (state 'a').

As discussed above, the dot diameter is varied according to the rate of decrease in driving voltage (see the divisions d1 and d2). In the printer with the plurality of nozzles Nz, however, it is extremely difficult to carry out the control that changes the waveform of the driving signal for each dot. This embodiment accordingly provides a driving signal COM including two pulse signals of different waveforms and determines transmission or block of these pulse signals based on print data, so as to create the medium dot and the small dot. This technique is described below in detail.

E. Driving Signal Generating Circuit and Driving Signal COM

Figure 10:
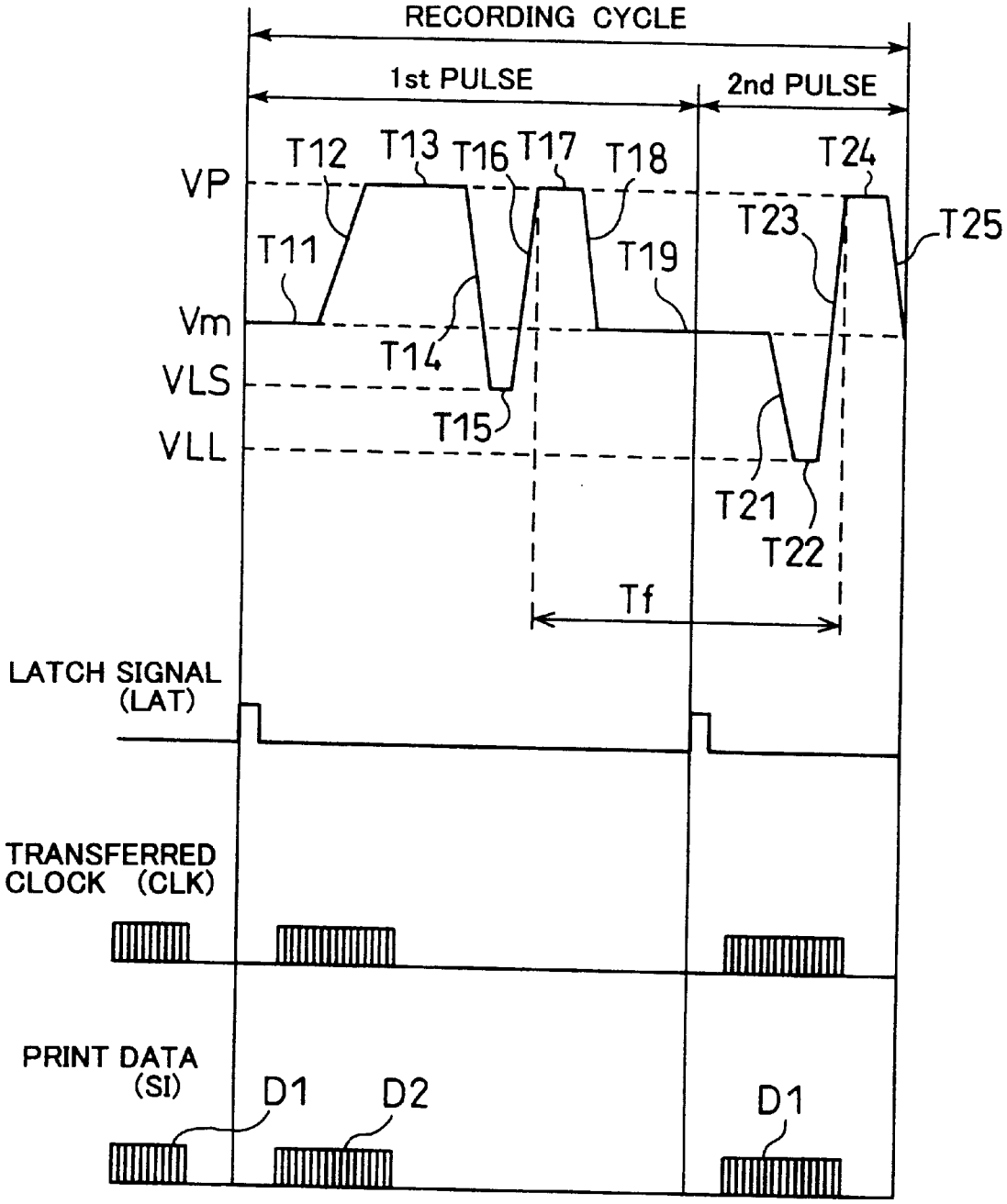
FIG. 10 shows waveforms of pulses included in a driving signal COM.

This embodiment provides two different types of driving waveforms, that is, a driving waveform for creating a small dot having a smaller dot diameter and a driving waveform for creating a medium dot having a greater dot diameter than that of the small dot, based on the relationship between the driving waveform and the dot diameter, as shown in FIG. 10. Ejection of large and small ink droplets in response to the different waveforms of the driving signal COM will be described later with the details of generation of the driving signal.

Figure 11:
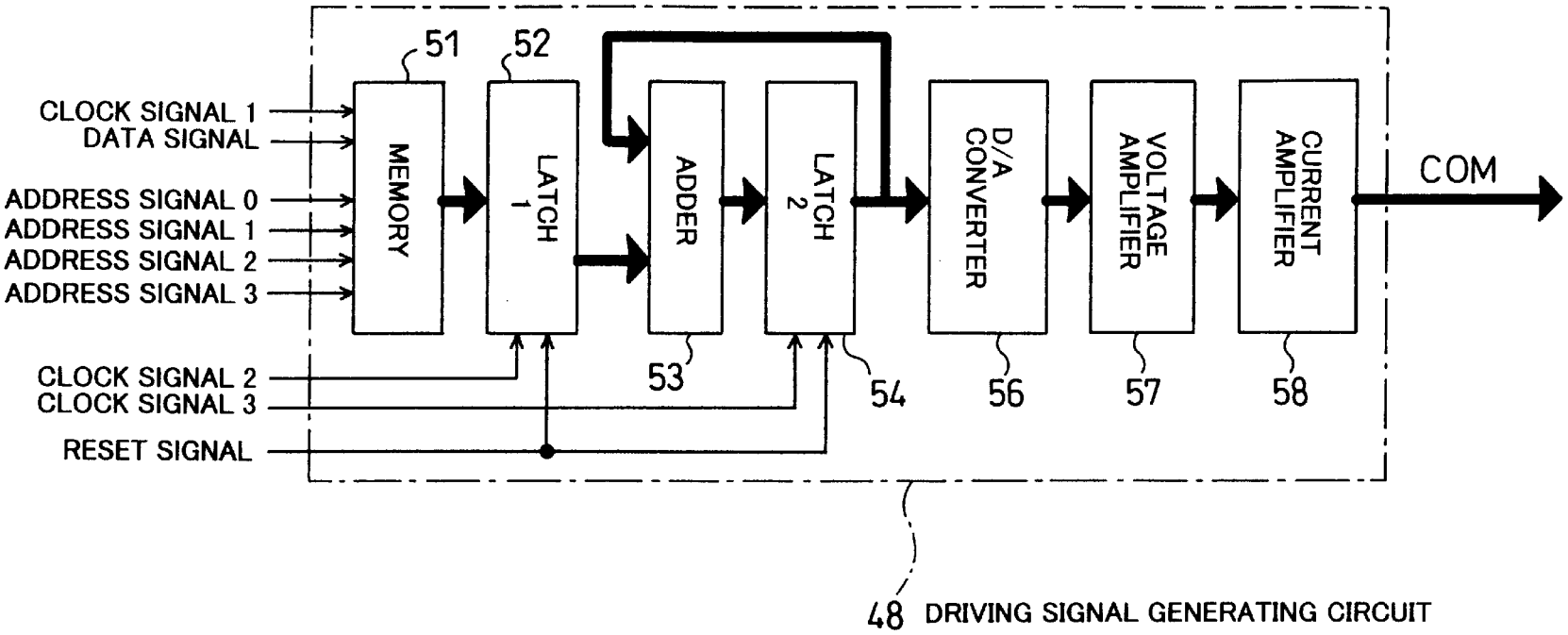
FIG. 11 is a block diagram showing the internal structure of a driving signal generating circuit 48.

The following describes the structure of generating the driving signal COM having the waveform shown in FIG. 10. The driving signal COM shown in FIG. 10 is generated by the driving signal generating circuit 48. FIG. 11 is a block diagram illustrating the internal structure of the driving signal generating circuit 48. The driving signal generating circuit 48 includes a memory 51 that receives and stores a signal generated by the controller 46, a latch 52 that reads the contents of the memory 51 and temporarily holds the contents, an adder 53 that adds the output of the latch 52 to the output of another latch 54, a D-A converter 56 that converts the output of the latch 54 to analog data, a voltage amplifier 57 that amplifies the converted analog signal to the amplitude of the voltage for driving the piezoelectric element PE, and a current amplifier 58 that feeds a supply of electric current corresponding to the amplified voltage signal. The memory 51 also stores predetermined parameters for specifying the waveform of the driving signal COM. As described later, the waveform of the driving signal COM depends upon the predetermined parameters, which are provided in advance by the controller 46. The driving signal generating circuit 48 receives clock signals 1, 2, and 3, data signals, and address signals 0 through 3, and a reset signal generated by the controller 46 as shown in FIG. 11.

Figure 12:
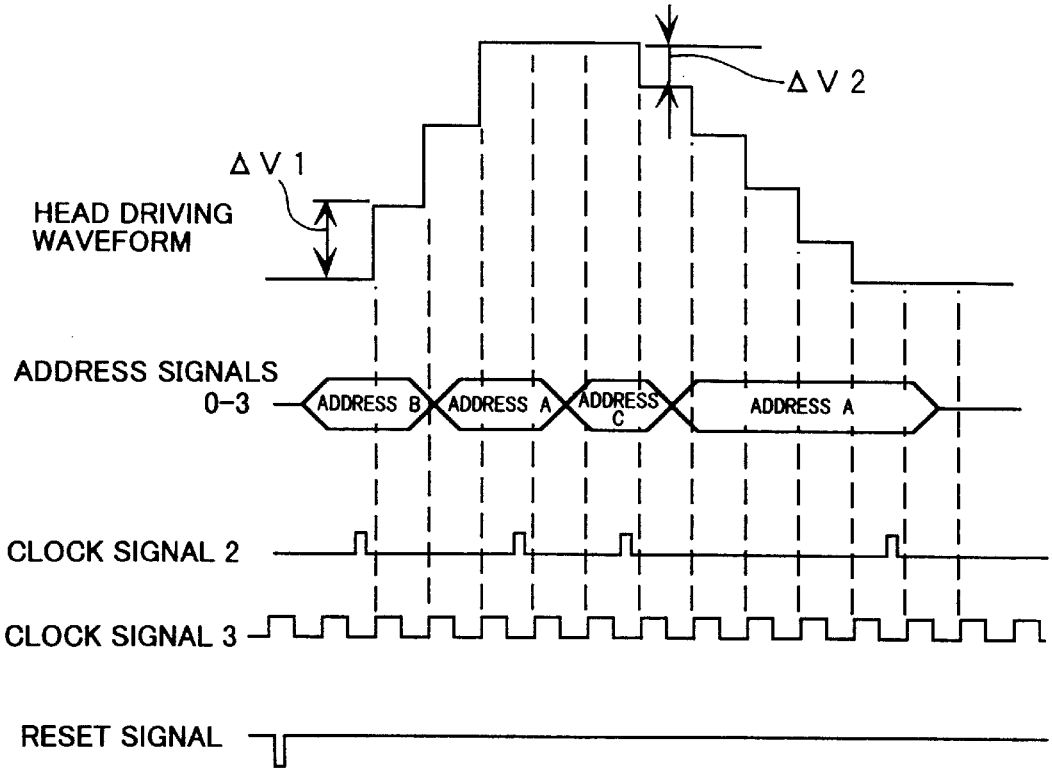
FIG. 12 shows a process of determining the waveform of the driving signal COM.
Figure 13:
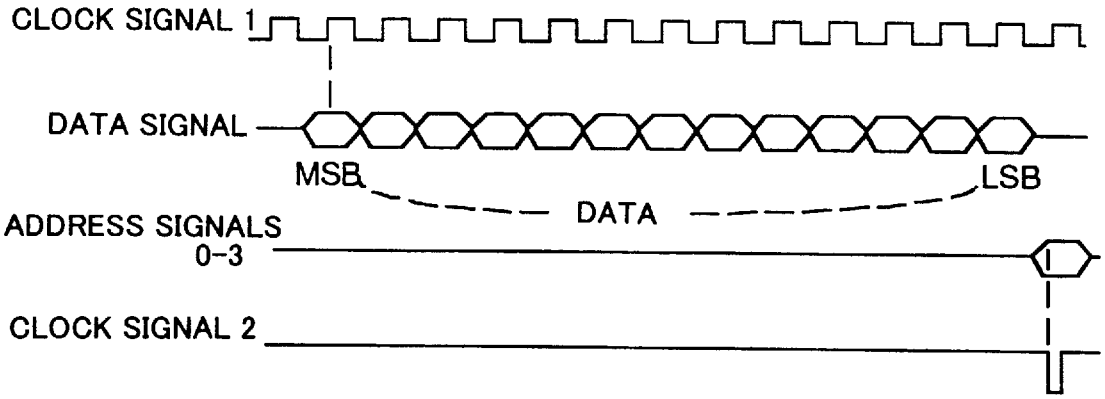
FIG. 13 is a timing chart showing timings of related signals when slew rates are set in a memory using data signals.

FIG. 12 shows a process of determining the waveform of the driving signal COM in the structure of the driving signal generating circuit 48 discussed above. Prior to generation of the driving signal COM, the controller 46 transmits a plurality of data signals representing slew rates of the driving signal and address signals corresponding to the data signals, synchronously with the clock signals 1 and 2 to the memory 51 in the driving signal generating circuit 48. Although the data signal is a one-bit signal, the serial transfer using the clock signal 1 as the synchronizing signal enables transmission of data as shown in the timing charge of FIG. 13. A certain slew rate is transferred from the controller 46 in the following manner. The controller 46 first outputs a data signal of plural bits synchronously with the clock signal 1 and subsequently outputs addresses in which the data are registered as the address signals 0 through 3 synchronously with the clock signal 2. The memory 51 reads the address signals 0 through 3 at a timing of the output of the clock signal 2 and writes the input data into the corresponding addresses. The address signal is a four-bit signal having the values of 0 through 3, so that sixteen slew rates at the maximum can be stored in the memory 51. The upper-most bit of the data denotes a sign.

This completes setting of the slew rates at respective addresses A, B, . . . . When the output address signals 0 through 3 represent the address B, the first output of the clock signal 2 causes the first latch 52 to hold the slew rate corresponding to the address B. The subsequent output of the clock signal 3 causes the second latch 54 to hold the sum of the output of the second latch 54 and the output of the first latch 52. Once a certain slew rate specified by the address signals 0 through 3 is selected, the output of the second latch 54 is varied according to the selected slew rate in response to every output of the clock signal 3. The slew rate registered at the address B represents an increase in voltage by a rate of voltage $\Delta V1$/unit time $\Delta T$. The increase or decrease in output of the second latch 54 depends upon the sign of the data registered at each address.

In the example of FIG. 12, the slew rate equal to zero, which represents a state of keeping the current voltage, is stored at the address A. When the clock signal 2 effects the address A, the waveform of the driving signal COM is kept in the state without any variation, that is, in the flat state. The slew rate corresponding to a decrease in voltage by a rate of voltage $\Delta V2$/unit time $\Delta T$ is stored at the address C. When the clock signal 2 effects the address C, the voltage gradually decreases at the rate of $\Delta V2/\Delta T$.

The controller 46 transmits the address signals 0 through 3 and the clock signal 2 according to the technique discussed above, so as to enable the waveform of the driving signal COM to be regulated freely. The controller 46 executes the computer program stored in the ROM 45 and thereby specifies the address signals 0 through 3 and the clock signal 2. The driving signal COM is then transmitted to the piezoelectric element driving circuit 50 via the I/F 49. The piezoelectric element driving circuit 50 determines whether or not the driving signal COM is to be transmitted to each nozzle on the print head 28. A driving signal that directly drives the respective nozzles is based on the waveform of the driving signal COM. The following describes the process of controlling the nozzles on the print head 28 in response to the pulses included in the driving signal COM and the principle of changing the dot diameter on the printing paper as a result of the control.

Referring back to FIG. 10, the driving signal COM has a first pulse and a second pulse in one recording cycle corresponding to one pixel in recording. The first pulse starts its voltage from an intermediate potential Vm (T11), rises to a maximum potential VP by a fixed gradient (T12), and keeps the maximum potential VP for a predetermined time period (T13). The first pulse subsequently lowers to a first minimum potential VLS by a fixed gradient (T14) and keeps the first minimum potential VLS for a predetermined time period (T15). The voltage of the first pulse again rises to the maximum potential VP by a fixed gradient (T16) and keeps the maximum potential VP for a predetermined time period (T17). The first pulse then lowers to the intermediate potential Vm by a fixed gradient (T18).

When the charging pulse T12 is applied to the piezoelectric element PE, the piezoelectric element PE deforms to reduce the volume of the pressure chamber 132, so that a positive pressure is evolved in the pressure chamber 132. The meniscus Me accordingly rises from the nozzle opening Nz. In the case where the charging pulse T12 has a large potential difference and a sharp voltage gradient, an ink droplet may be ejected in response to the charging pulse T12. In this embodiment, however, the potential difference of the charging pulse T12 is set in a range that does not enable ejection of an ink droplet in response to the charging pulse T12.

The meniscus Me rising in response to the charging pulse T12 moves back into the nozzle opening Nz by means of the surface tension of ink while the hold pulse T13 is applied. Application of the discharging pulse T14 deforms the piezoelectric element PE to expand the pressure chamber 132, so that a negative pressure is evolved in the pressure chamber 132. The movement of the meniscus Me into the nozzle opening Nz by the negative pressure is superposed upon the backward movement (vibration) of the meniscus Me into the nozzle opening Nz by means of the surface tension of ink. The meniscus Me is thus significantly pulled inside the nozzle opening Nz. The application of the discharging pulse T14 at the timing when the meniscus Me moves into the nozzle opening Nz enables the meniscus Me to be significantly pulled inside the nozzle opening Nz, even if the discharging pulse T14 has a relatively small potential difference.

When the charging pulse T16 is applied in the state where the meniscus Me is significantly pulled inside the nozzle opening Nz, a positive pressure is evolved in the pressure chamber 132 and the meniscus Me rises from the nozzle opening Nz. Since the meniscus Me is significantly concaved inward the nozzle opening Nz, application of the positive pressure causes a small ink droplet to be ejected. The discharging pulse T18 relieves the natural oscillation of the meniscus Me excited by the discharging pulse T14 and the charging pulse T16. The discharging pulse T18, which moves the meniscus Me into the nozzle opening Nz, is applied at the timing when the natural oscillation moves the meniscus Me towards the nozzle opening Nz. This restricts the recession of the meniscus Me after the ejection of a small ink droplet to a relatively small level.

The second pulse, which follows the first pulse, starts its voltage from the intermediate potential Vm (T19), lowers to a second minimum potential VLL by a fixed gradient (T21) and keeps the second minimum potential VLL for a predetermined time period (T22). The second minimum potential VLL of the second pulse is lower than the first minimum potential VLS of the first pulse. The voltage of the second pulse subsequently increases to the maximum potential VP by a fixed gradient (T23) and keeps the maximum potential VP for a predetermined time period (T24). The second pulse then lowers to the intermediate potential Vm by a fixed gradient (T25).

The application of the discharging pulse T21 causes a negative pressure to be evolved in the pressure chamber 132 as described previously, and pulls the meniscus Me into the nozzle opening Nz. The potential difference of the discharging pulse T21 is set to be smaller than the potential difference of the discharging pulse T14 of the first pulse. The slew rate is accordingly set to prevent the meniscus Me from being less significantly pulled inward the nozzle opening Nz, compared with the first pulse.

The subsequent application of the charging pulse T23 causes a positive pressure to be evolved in the pressure chamber 132 and makes the meniscus Me rise from the nozzle opening Nz. Since the positive pressure is evolved in the state where the meniscus Me is only slightly pulled inward the nozzle opening Nz, the ink droplet ejected in response to the second pulse is larger than that ejected in response to the first pulse. The last discharging pulse T25 of the second pulse relieves the natural oscillation of the meniscus Me excited by the discharging pulse T21 and the charging pulse T23. The discharging pulse T25 is applied at the timing when the natural oscillation moves the meniscus Me towards the nozzle opening Nz.

As discussed above, the driving signal COM includes the first pulse and the second pulse in succession in one recording cycle corresponding to one pixel in printing, thereby enabling ejection of a small ink droplet in response to the first pulse and a large ink droplet in response to the second pulse. In this embodiment, the driving signal COM does not directly drive the piezoelectric elements PE. The piezoelectric element driving circuit 50 selects one or two desired pulses out of the first pulse and the second pulse included in the driving signal COM and generates a driving signal for driving the respective piezoelectric elements.

In the case where the driving signal for driving the piezoelectric elements includes only the first pulse, a small ink droplet is ejected from the nozzle to create a small dot having a smaller dot diameter. In the case where the driving signal for driving the piezoelectric elements includes only the second pulse, a large ink droplet is ejected from the nozzle to create a medium dot having a greater dot diameter than that of the small dot. When the driving signal for driving the piezoelectric elements includes both the first pulse and the second pulse, both a small ink droplet and a large ink droplet are ejected from the nozzle to create a large dot having a greatest dot diameter.

Figure 14:
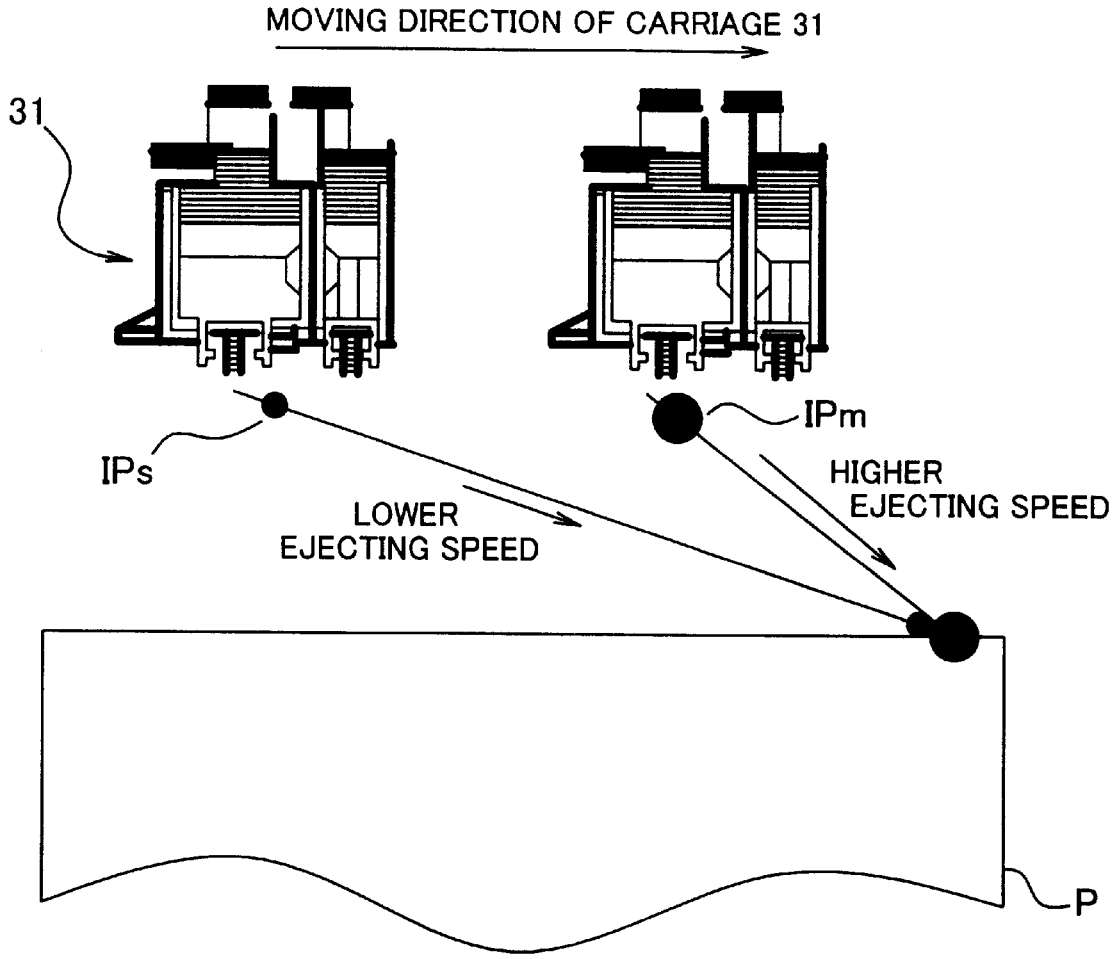
FIG. 14 shows the state of hitting a large ink droplet and a small ink droplet ejected from the nozzle against a sheet of printing paper.

The small ink droplet ejected in response to the first pulse and the large ink droplet ejected in response to the second pulse hit on substantially identical positions on the printing sheet. FIG. 14 shows such a state. In the example of FIG. 14, a small ink droplet IPs in response to the first pulse and a large ink droplet IPm in response to the second pulse hit on substantially the same positions on the printing paper P. In the case where the driving signal shown in FIG. 10 is used to create the two different types of dots, since the second pulse causes a greater amount of change of the piezoelectric element PE, the ejecting speed of the large ink droplet IPm is higher than the ejecting speed of the small ink droplet IPs. For example, it is assumed that a small ink droplet and a large ink droplet are ejected in this sequence while the carriage 31 moves in the main scanning direction. In this example, the scanning speed of the carriage 31 and the ejection timings of both the small ink droplet and the large ink droplet can be regulated according to the distance (platen gap) between the print head 28 on the carriage 31 and the printing paper P. Because of the existing difference between the ejecting speeds of the small ink droplet and the large ink droplet, such regulation enables the small ink droplet and the large ink droplet to reach the printing paper P at substantially identical timings. In the structure of the embodiment, a small ink droplet and a large ink droplet hit on substantially the same positions on the printing sheet in response to the two different types of driving pulses shown in FIG. 10, thereby creating a large dot having the greatest dot diameter. While there is a difference between the ejecting speeds of the small ink droplet and the large ink droplet, the regulation discussed above enables the small dot and the medium dot, which respectively correspond to the small ink droplet and the large ink droplet, to be created at substantially identical positions.

F. Piezoelectric Element Driving Circuit

Figure 15:
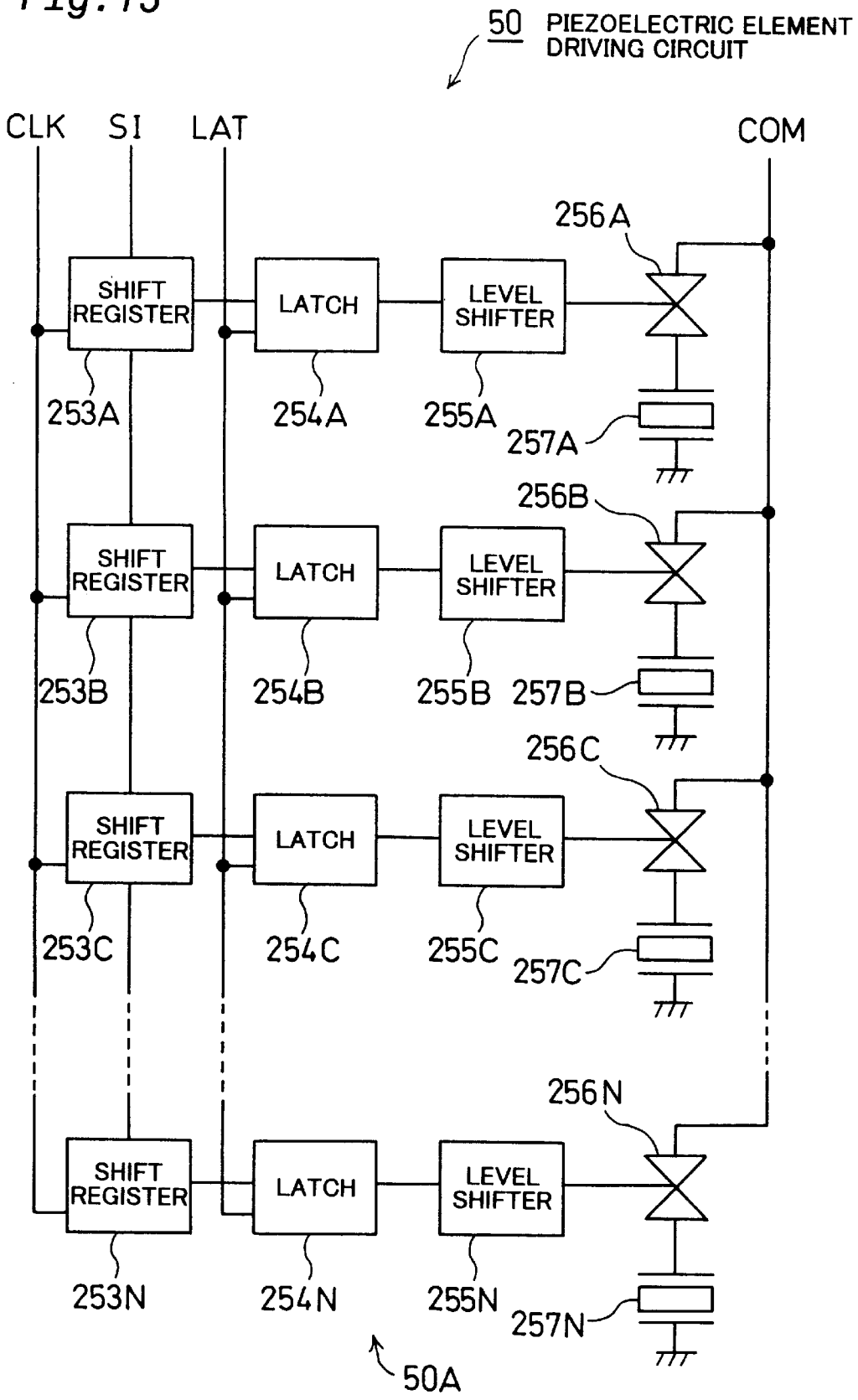
FIG. 15 is a block diagram showing the internal structure of a piezoelectric element driving circuit 50.

FIG. 15 is a block diagram illustrating the internal structure of the piezoelectric element driving circuit 50. The piezoelectric element driving circuit 50 includes shift registers 253A through 253N, latch elements 254A through 254N, level shifters 255A through 255N, switch elements 256A through 256N, and piezoelectric elements 257A through 257N corresponding to the respective nozzles on the print head 28. The print data is two-bit data with regard to each nozzle and expressed like '10' and '11'. The bit data of the respective places included in the two-bit print data with regard to all the nozzles are input into the shift registers 253A through 253N in one recording cycle.

The data of the upper bit or bit 2 data with regard to all the nozzles are serial transferred to the shift registers 253A through 253N and subsequently latched by the latch elements 254A through 254N. In the course of the latch operation, the data of the lower bit or bit 1 data with regard to all the nozzles are serial transferred to the shift registers 253A through 253N.

In the case where the bit data '1' is supplied to the respective switch elements 256A through 256N, which are constructed as analog switches, the driving signal COM transferred from the driving signal generating circuit 48 via the I/F 49 is directly supplied to the piezoelectric elements 257A through 257N as the driving signal for driving the piezoelectric elements. The piezoelectric elements 257A through 257N deform in response to the waveform of the driving signal COM. In the case where the bit data '0' is supplied to the respective switch elements 256A through 256N, on the other hand, the transfer of the driving signal COM to the piezoelectric elements 257A through 257N is blocked. The piezoelectric elements 257A through 257N accordingly hold the previous electric charges.

The print data may express four tones, that is, no creation of dot (tone value 1), creation of a small dot (tone value 2), creation of a medium dot (tone value 3), and creation of a large dot (tone value 4). The respective tone values 1 through 4 may be expressed as two-bit tone data like '00', '01'. '10', and '11'. In the case of the tone value 2 where only a small ink droplet is ejected to create a small dot, the bit data '1' is supplied to the switch element 256 synchronously with the first pulse, whereas the bit data '0' is supplied to the switch element 256 synchronously with the second pulse. This enables only the first pulse to be applied to the piezoelectric element 257. Decoding the two-bit tone data '01' representing the tone value 2 into the two-bit print data '10' representing application of the first pulse and non-application of the second pulse causes only the first pulse to be applied to the piezoelectric element 257, so as to attain the tone value 2 representing creation of a small dot.

In a similar manner, supply of the decoded two-bit print data '01' to the switch element 256 causes only the second pulse to be applied to the piezoelectric element 257. This causes a large ink droplet to hit against the printing paper, so as to create a medium dot and thereby attain the tone value 3. Supply of the decoded two-bit print data '11' to the switch element 256 causes both the first pulse and the second pulse to be applied to the piezoelectric element 257. This causes a small ink droplet and a large link droplet to successively hit against substantially the same position on the printing paper, so as to create a large dot and thereby attain the tone value 4. In the case of the tone value 1, which represents no ejection of an ink droplet and no creation of a dot, the decoded two-bit print data '00' is supplied to the switch element 256. This causes no pulse to be applied to the piezoelectric element 257 and attains the tone value 1 representing creation of no dot.

The following describes a concrete structure for supplying the 2-bit print data to the switch elements 256. The output buffer 44C stores two-bit print data (D1,D2) decoded by the controller 46. Here D1 represents a selection signal of the first pulse, and D2 represents a selection signal of the second pulse. The two-bit print data are given to the switch elements 256 corresponding to the respective nozzles on the print head 28 in one recording cycle. When the number of nozzles on the print head 28 is equal to n and when (D11,D21) represents the print data with regard to a first nozzle at a certain position in the sub-scanning direction, (D21,D22) represents the print data with regard to a second nozzle at the certain position, and the like, the data (D11,D12,D13, . . . ,D1n) of the first pulse selection signal D1 with regard to all the nozzles are serial input into the shift registers 253 synchronously with the clock signal. In a similar manner, the data (D21,D22,D23, . . . , D2n) of the second pulse selection signal D2 with regard to all the nozzles are transferred to the shift registers 253 in one recording cycle. This is shown in the bottom of FIG. 10.

Referring to FIG. 10, prior to the timing for generating a target driving pulse, print data for selecting the target driving pulse have been transferred to the shift registers 253. The print data in the shift registers 253 are then transferred to and stored in the latch elements 254 synchronously with generation of the target driving pulses. The print data in the latch elements 254 are subjected to a pressure increase by the level shifters 255 and transferred to the switch elements 256, so that the driving signal COM is supplied to the piezoelectric elements 257 via the switch elements 256.

G. Reduction of Positional Deviation of Dots due to Difference between Selection Pulses for Creating Small Dot and Medium Dot in Adjoining Two Pixels In the structure of this embodiment, a small dot and a medium dot are created respectively in response to the first pulse and the second pulse in two pixels adjoining to each other in the main scanning direction. When a small dot and a medium dot are created respectively in two pixels adjoining to each other in the main scanning direction, one case ejects a small ink droplet in a preceding pixel and a large ink droplet in a following pixel. The other case carries out ink ejection in the inverted sequence, that is, ejects a large ink droplet in the preceding pixel and a small ink droplet in the following pixel.

The image processing by the application program 95 practically does not differentiate the creation of a small dot and a medium dot in this sequence (hereinafter referred to as the normal sequence) from the same in the inverted sequence. The driving signal generated by the piezoelectric element driving circuit 50 has different waveforms in the normal sequence and in the inverted sequence, so that the positional relationship of the two dots created in response to the driving signal in the normal sequence is different from that in the inverted sequence.

Figure 16:
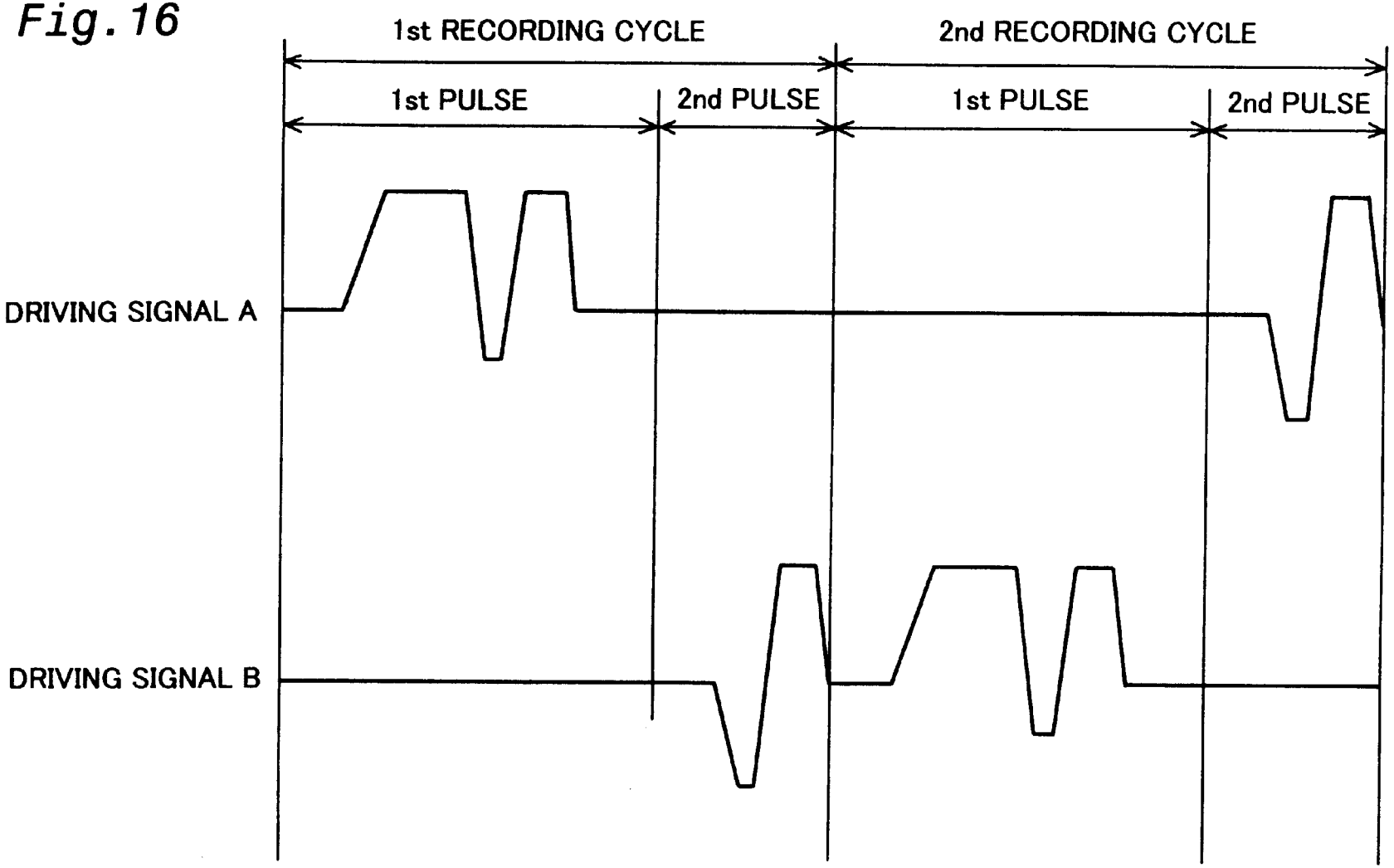
FIG. 16 shows the comparison between a driving signal A and another driving signal B.

FIG. 16 shows a driving signal A for creating a small dot and a medium dot in this sequence and another driving signal B for creating a small dot and a medium dot in the inverted sequence. The waveform of the driving signal A for attaining the sequence of a small dot and a medium dot includes only the first driving pulse in a first recording cycle corresponding to a preceding pixel and only the second driving pulse in a second recording cycle corresponding to a following pixel. The waveform of the driving signal B for attaining the sequence of a medium dot and a small dot, on the other hand, includes only the second driving pulse in the first recording cycle corresponding to the preceding pixel and only the first driving pulse in the second recording cycle corresponding to the following pixel.

Figure 25:
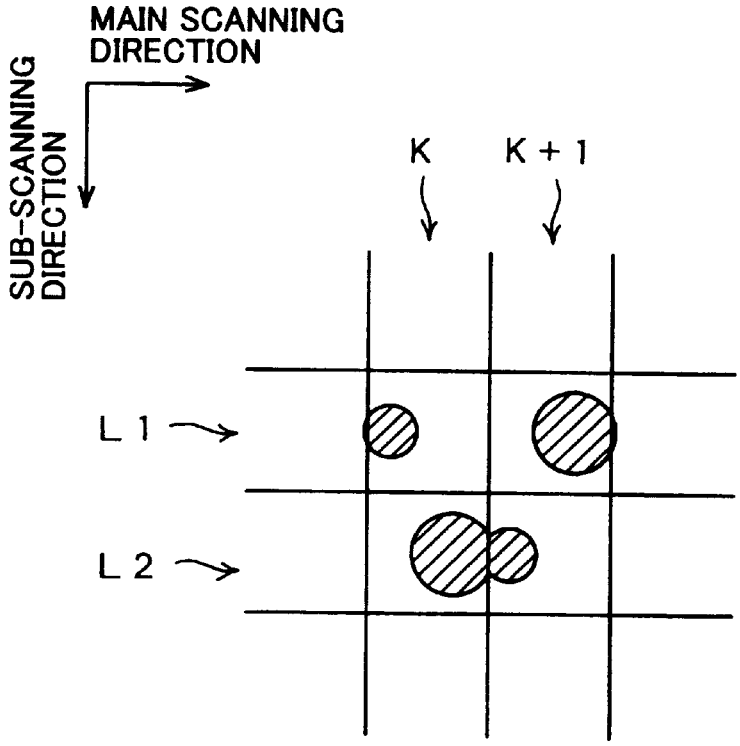
FIG. 25 shows a variation in distance between two different types of dots in the main scanning direction recorded by the prior art technique.

In the driving signal A, there is a significant time difference between two driving pulses for creating two dots. In the driving signal B, on the other hand, there is a little time difference between two driving pulses for creating two dots. The prior art technique causes a relatively large distance between two resulting dots in the case of the driving signal A, while causing substantially no distance between two resulting dots in the case of the driving signal B (see FIG. 25). The technique of this embodiment attains substantially equal distances between two resulting dots in the case of ejecting a small ink droplet and a large ink droplet in this sequence in response to the driving signal A and in the case of ejecting a small ink droplet and a large ink droplet in the inverted sequence in response to the driving signal B, as discussed in detail below.

Figure 17:
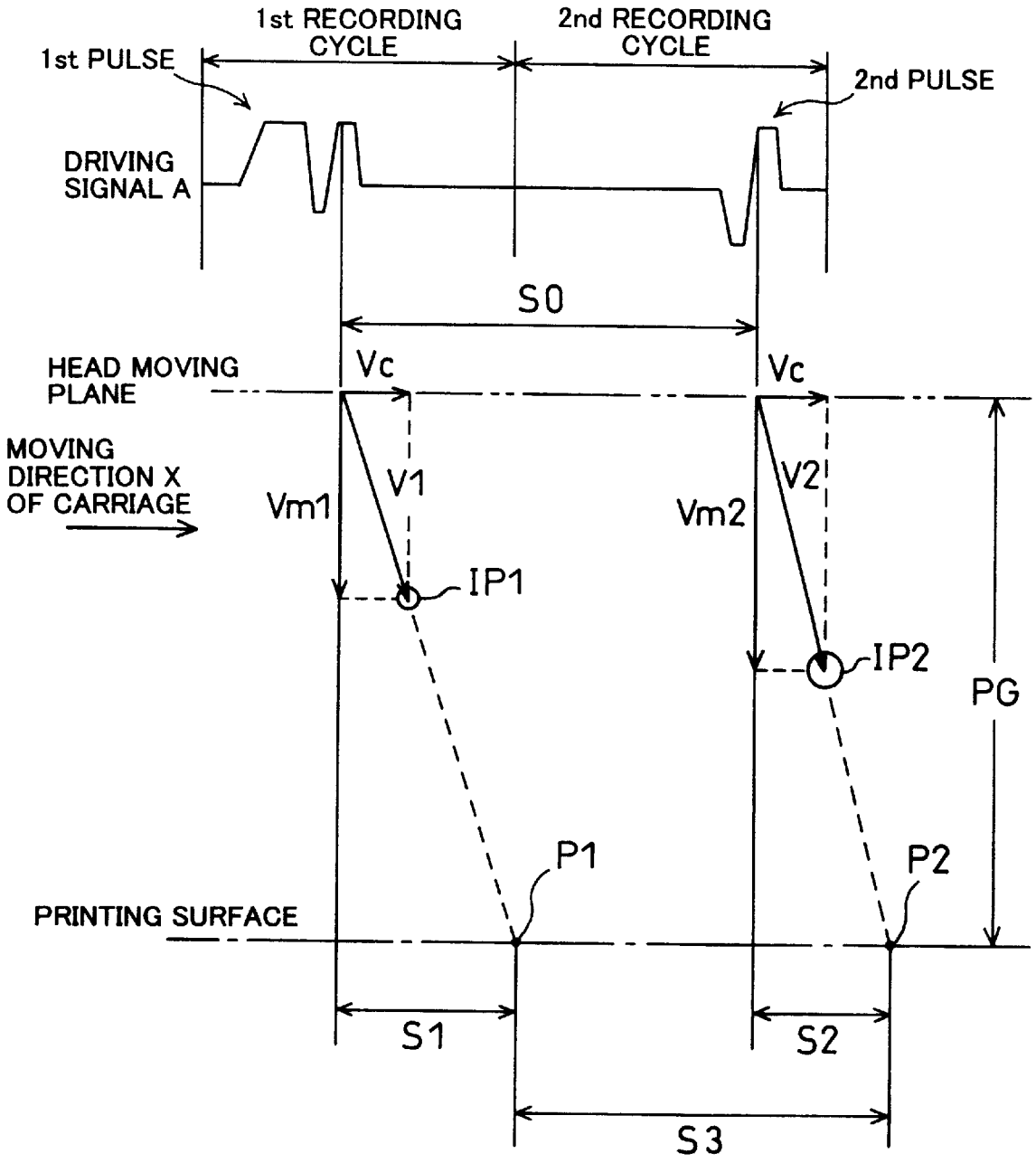
FIG. 17 shows the hitting positions of a small ink droplet, which corresponds to a first pulse, and a large ink droplet, which corresponds to a second pulse, ejected in response to the driving signal A.

FIG. 17 shows the hitting positions of a small ink droplet ejected corresponding to the first pulse and a large ink droplet ejected corresponding to the second pulse in the driving signal A. The two-dot chain line represents the moving plane of each of the ink ejection heads 61 through 66 on the print head 28. Each of the ink ejection heads 61 through 66 shifts its moving plane at a velocity Vc, accompanied with the movement (main scan) of the carriage 31 in the X direction. During the shift of the moving plane, a small ink droplet IP1 corresponding to the first pulse in the first recording cycle is ejected downward in the vertical direction at an ejecting speed Vm1. After elapse of a predetermined time period TA, a large ink droplet IP2 corresponding to the second pulse in the second recording cycle is ejected downward in the vertical direction at an ejecting speed Vm2.

The time difference between the ejection timing of the small ink droplet IP1 and the ejection timing of the large ink droplet IP2 is equal to the predetermined time period TA as mentioned above. The predetermined time period TA is equal to the sum of a basic ejection period Tf and an ejection timing difference T0 as expressed by Equation (1) given below. Here the basic ejection period Tf denotes a period for successively ejecting ink droplets of a fixed size. The ejection timing difference T0 denotes a time difference between the ejection timing of a first ink droplet and the ejection timing of a second ink droplet.

$$TA = Tf + T0 \quad (1)$$

The time period TA may be converted to the distance. Equation (2) given below shows a distance S0 between the position of ejecting the small ink droplet IPI and the position of ejecting the large ink droplet IP2.

$$S0 = Vc(Tf + T0) \quad (2)$$

The small ink droplet IP1 corresponding to the first pulse drops at an ejecting speed V1 in a specific direction defined by the vector of ejection downward in the vertical direction and the vector of movement of the head in the main scanning direction, and hits against the surface of printing paper, which is shown by the one-dot chain line in FIG. 17 and is apart from the head moving plane by a platen gap PG. A hitting position P1 of the small ink droplet IP1 on the surface of printing paper is apart from the position of ejecting the small ink droplet IP1 by a distance S1 in the X direction. The distance S1 is expressed by Equation (3) given below:

$$S1=PG\cdot Vc/Vm1 \quad (3)$$

The large ink droplet IP2 corresponding to the second pulse, on the other hand, drops at an ejecting speed V2 in a specific direction defined by the vector of ejection downward in the vertical direction and the vector of movement of the head in the main scanning direction, and hits against the surface of printing paper, which is apart from the head moving plane by the platen gap PG. A hitting position P2 of the large ink droplet IP2 on the surface of printing paper is apart from the position of ejecting the large ink droplet IP2 by a distance S2 in the X direction. The distance S2 is expressed by Equation (4) given below:

$$S2=PG\cdot Vc/Vm2 \quad (4)$$

According to Equations (2) through (4), a distance S3 between the hitting position P1 of the small ink droplet IP1 and the hitting position P2 of the large ink droplet IP2 is expressed by Equation (5) given below:

$$S3 = S0 + S2 - S1 \quad (5)$$
$$= Vc(Tf + T0) + PG\cdot Vc/Vm2 - PG\cdot Vc/Vm1$$

Figure 18:
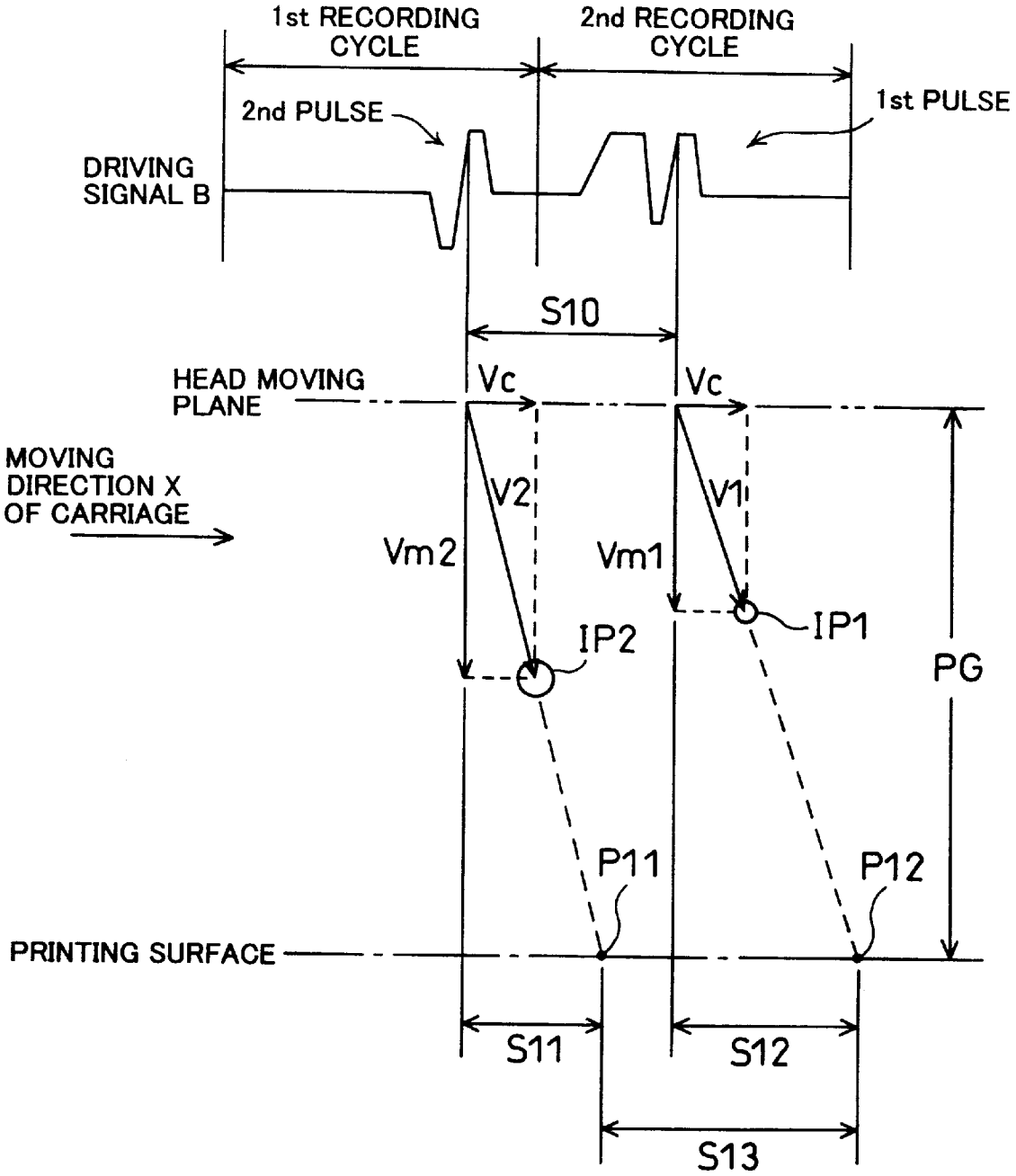
FIG. 18 shows the hitting positions of the large ink droplet, which corresponds to the second pulse, and the small ink droplet, which corresponds to the first pulse, ejected in response to the driving signal B.

FIG. 18 shows the hitting positions of a large ink droplet ejected corresponding to the second pulse and a small ink droplet ejected corresponding to the first pulse in the driving signal B. Each of the ink ejection heads 61 through 66 shifts its moving plane at the velocity Vc, accompanied with the main scan of the carriage 31 in the X direction. During the shift of the moving plane, a large ink droplet IP2 corresponding to the second pulse in the first recording cycle is ejected downward in the vertical direction at the ejecting speed Vm2. After elapse of a predetermined time period TB, a small ink droplet IP1 corresponding to the first pulse in the second recording cycle is ejected downward in the vertical direction at the ejecting speed Vm1.

The time difference between the ejection timing of the large ink droplet IP2 and the ejection timing of the small ink droplet IP1 is equal to the predetermined time period TB as mentioned above. The predetermined time period TB is expressed by Equation (6) given below.

$$TB=Tf-T0 \quad (6)$$

The time period TB may be converted to the distance. Equation (7) given below shows a distance S10 between the position of ejecting the large ink droplet IP2 and the position of ejecting the small ink droplet IP1.

$$S10=Vc(Tf-T0) \quad (7)$$

The large ink droplet IP2 corresponding to the second pulse drops at the ejecting speed V2 in the specific direction defined by the vector of ejection downward in the vertical direction and the vector of movement of the head in the main scanning direction, and hits against the surface of printing paper, which is apart from the head moving plane by the platen gap PG. A hitting position P11 of the large ink droplet IP2 on the surface of printing paper is apart from the position of ejecting the large ink droplet IP2 by a distance S11 in the X direction. The distance S11 is expressed by Equation (8) given below:

$$S11=PG\cdot Vc/Vm2 \quad (8)$$

The small ink droplet IP1 corresponding to the first pulse, on the other hand, drops at the ejecting speed VI in the specific direction defined by the vector of ejection downward in the vertical direction and the vector of movement of the head in the main scanning direction, and hits against the surface of printing paper, which is apart from the head moving plane by the platen gap PG. A hitting position P12 of the small ink droplet IP1 on the surface of printing paper is apart from the position of ejecting the small ink droplet Ip1 by a distance S12 in the X direction. The distance S12 is expressed by Equation (9) given below:

$$S12=PG\cdot Vc/Vm1 \quad (9)$$

According to Equations (7) through (9), a distance S13 between the hitting position P11 of the large ink droplet IP2 and the hitting position P12 of the small ink droplet Ip1 is expressed by Equation (10) given below:

$$S13 = S10 + S12 - S11 \quad (10)$$
$$= Vc(Tf - T0) + PG\cdot Vc/Vm1 - PG\cdot Vc/Vm2$$

Figure 19:
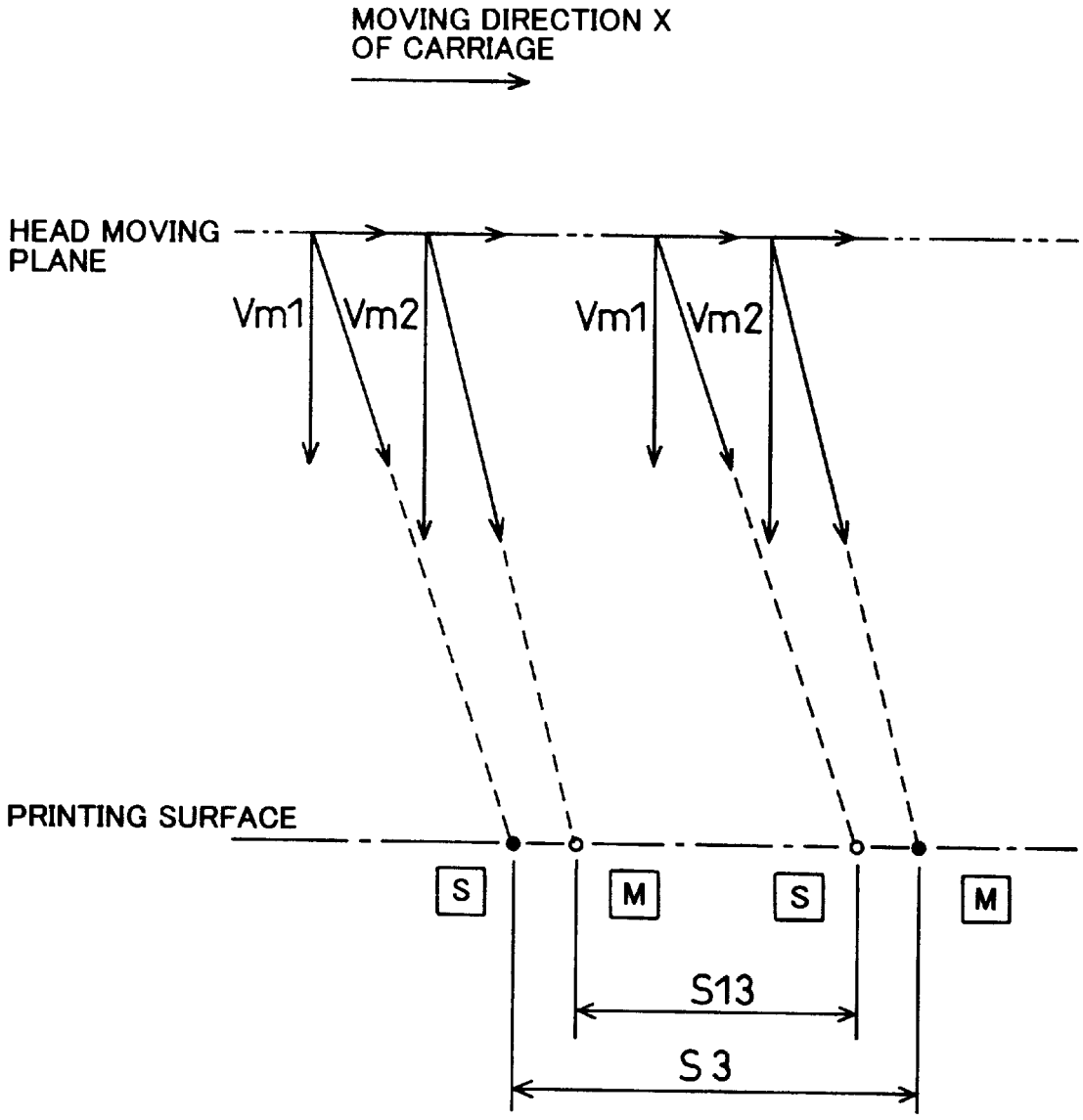
FIG. 19 shows the comparison of a distance S3 between the hitting positions of the two ink droplets shown in FIG. 17 with a distance S13 between the hitting positions of the two ink droplets shown in FIG. 18.

FIG. 19 shows the comparison of the distance S3 between the hitting positions of the two ink droplets shown in FIG. 17 with the distance S13 between the hitting positions of the two ink droplets shown in FIG. 18. The squares surrounding the letters S and M show that small dots and medium dots are created at the respective hitting positions. The distance S3 is generally greater than the distance S13. As described previously, it is, however, demanded that the inter-dot distance in the case of ejecting a small ink droplet and a large ink droplet in response to the driving signal A is equal to the inter-dot distance in the case of ejecting a large ink droplet and a small ink droplet in response to the driving signal B. It is accordingly required to equalize the distance S3 with the distance S13. The procedure of this embodiment accordingly substitutes the distance S3 obtained by Equation (5) and the distance S13 obtained by Equation (10) into an equation of S3−S13 =0 and rewrites the equation to Equation (11) given below:

$$2Vc(T0+PG/Vm2-PG/Vm1)=0 \quad (11)$$

Equation (11) is rewritten as Equation (12) given below:

$$1/Vm1-1/Vm2=T0/PG \quad (12)$$

Equation (12) shows that regulation of the ejecting speed Vm1 of the small ink droplet IP1, the ejecting speed Vm2 of the large ink droplet IP2, and the ejection timing difference T0 according to the platen gap PG equalizes the distance S3 between the hitting positions of the two ink droplets ejected in response to the driving signal A with the distance S13 between the hitting positions of the two ink droplets ejected in response to the driving signal B. According to Equations (1) and (6), the ejection timing difference T0 is expressed by Equation (13) given below:

$$T0=(TA-TB)/2 \quad (13)$$

The ejection timing difference T0 is accordingly half the difference between the time difference TA in the ejection timings of the first ink droplet and the second ink droplet in response to the driving signal A and the time difference TB in the ejection timings of the first ink droplet and the second ink droplet in response to the driving signal B.

The technique of this embodiment regulates the ejecting speed Vm1 of the ink droplet IP1 corresponding to the first pulse, the ejecting speed Vm2 of the ink droplet IP2 corresponding to the second pulse, and the difference (=2T0) between the time difference TA in the ejection timings of the first ink droplet and the second ink droplet in response to the driving signal A and the time difference TB in the ejection timings of the first ink droplet and the second ink droplet in response to the driving signal B, in such a manner that they satisfy the relationship defined by Equation (12) given above. With regard to the driving signal shown in FIG. 10, for example, the concrete procedure of regulation may change the gradient in the division T16 or in the division T14 to regulate the ejecting speed Vm1 of the ink droplet Ip1 corresponding to the first pulse, change the gradient in the division T23 or in the division T21 to regulate the ejecting speed Vm2 of the ink droplet IP2 corresponding to the second pulse, or change the time difference T19 between the terminal point of the division T18 and the starting point of the division T21 to regulate the time differences TA and TB and thereby the ejection timing difference T0.

The regulation process may regulate both the ejecting speeds Vm and the ejection timing difference T0 or may alternatively regulate either one of them while the other is fixed. In the case where the ejecting speeds Vm1 and Vm2 of the ink droplets Ip1 and IP2 are kept to fixed values, the regulation process regulates the difference (=2T0) between the time difference TA in the ejection timings of the first ink droplet and the second ink droplet in response to the driving signal A and the time difference TB in the ejection timings of the first ink droplet and the second ink droplet in response to the driving signal B, in such a manner that they satisfy Equation (15) given below:

$$T0=PG\cdot(1/Vm1-1/Vm2) \quad (15)$$

In the case where the ejection timing difference T0 is kept to a fixed value, on the other hand, the regulation process regulates the ejecting speed Vm1 of the ink droplet Ip1 corresponding to the first pulse and the ejecting speed Vm2 of the ink droplet IP2 corresponding to the second pulse, in such a manner that they satisfy Equation (16) given below:

$$Vm2=Vm1/(1-T0\cdot Vm1/PG) \quad (16)$$

As discussed previously, the waveform of the driving signal is changed by regulating the address signals and the clock signals that are generated by the controller 46 and output to the driving signal generating circuit 48.

While both the ejecting speeds Vm and the ejection timing difference T0 are kept to fixed values, regulation of the platen gap PG enables the relationship of Equation (12) to be satisfied. In this case, the platen gap PG is regulated to satisfy Equation (17) given below. The regulation of the platen gap PG is attained by a known regulation motor, which regulates the interval between the print head 28 and the printing paper.

$$PG=T0/(1/Vm1-1/Vm2) \quad (17)$$

Any of the above regulation processes enables the distance between the hitting positions of the two ink droplets IP1 and IP2 in the case where the ink droplets Ip1 and IP2 corresponding to the first pulse and the second pulse are ejected in response to the driving signal A to be substantially equal to the same in the case where the ink droplets IP1 and IP2 are ejected in response to the driving signal B. This control procedure accordingly prevents the distance between the hitting positions of the two ink droplets from being too close to each other or too far from each other, when two different types of dots, a medium dot and a small dot, are to be created in two pixels adjoining to each other in the main scanning direction.

When the ejecting speed Vm2 of the large ink droplet IP2 is a times (where a is a value greater than one) the ejecting speed Vm1 of the small ink droplet Ip1, Equation (11) is rewritten as Equation (18) given below:

$$\alpha=1/(1-T0\cdot Vm1/PG) \quad (18)$$

The process of determining the ratio a of the ejecting speed Vm2 of the large ink droplet IP2 to the ejecting speed Vm1 of the small ink droplet IP1 to satisfy Equation (18) also enables the distance S3 between the hitting positions of the two ink droplets ejected in response to the driving signal A to be substantially equal to the distance S13 between the hitting positions of the two ink droplets ejected in response to the driving signal B.

Figure 20:
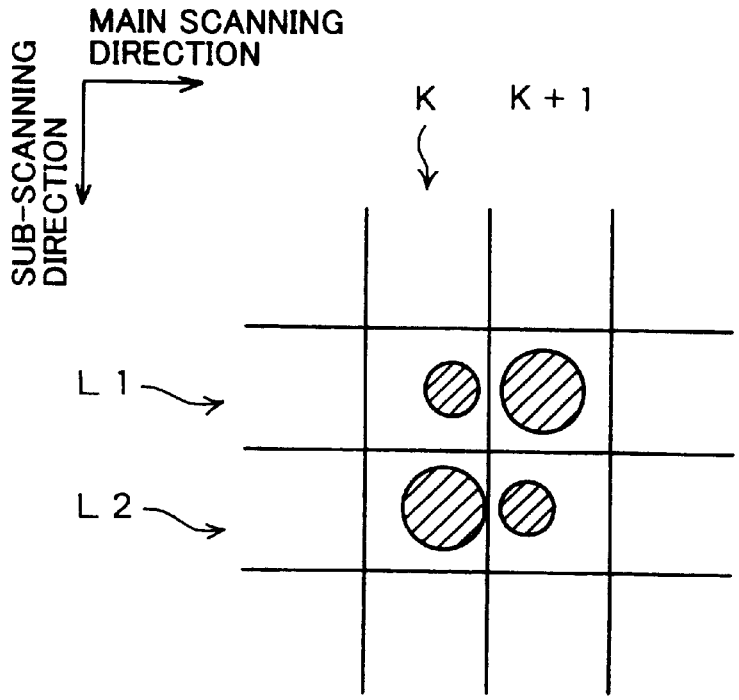
FIG. 20 shows the distance between two different types of dots recorded by the technique of the embodiment.

FIG. 20 shows the inter-dot distance when two different types of dots, a medium dot and a small dot, are recorded by the technique of this embodiment. Dots are created in response to the driving signal A in a k-th pixel and a (k+1)-th pixel (where k is a positive number) on a first raster line L1, which adjoin to each other in the main scanning direction. Dots are created in response to the driving signal B, on the other hand, in a k-th pixel and a (k+1)-th pixel (where k is a positive number) on a second raster line L2, which adjoin to each other in the main scanning direction. As clearly understood from the illustration of FIG. 20, the technique of this embodiment enables the distance between the small dot and the medium dot on the first raster line L1 created in response to the driving signal A and the distance between the medium dot and the small dot on the second raster line L2 created in response to the driving signal B to be practically set to a relatively small identical value.

As discussed above in detail, the printing system of this embodiment enables the distance between two different types of dots, a medium dot and a small dot, to be substantially fixed to a relatively small value, irrespective of the combination of the selected driving pulses, when the two different types of dots are created respectively in two pixels adjoining to each other in the main scanning direction in response to the driving signal, which may selectively include two driving pulses in one cycle corresponding to one pixel. This accordingly ensures the excellent picture quality of the resulting printed image.

H. Modifications

Figure 21:
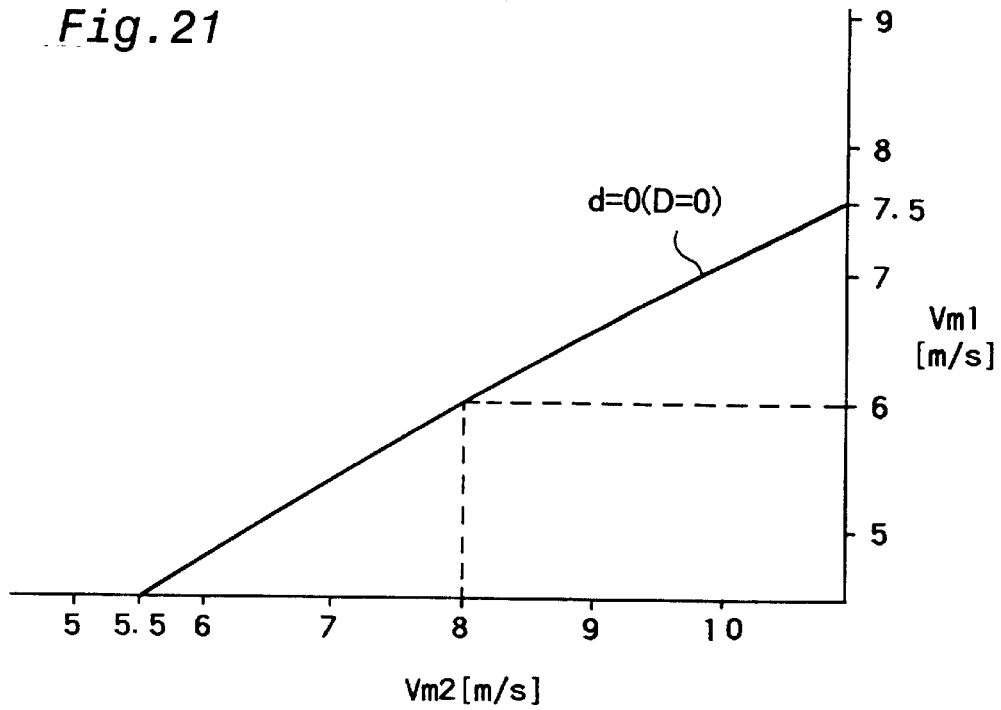
FIG. 21 is a graph showing the ejecting speed Vm1 of the first ink droplet plotted against the ejecting speed Vm2 of the second ink droplet in this embodiment.

Some possible modifications of the embodiment will be discussed below, after further description of the above embodiment. FIG. 21 is a graph showing the ejecting speed Vm1 of the first ink droplet plotted against the ejecting speed Vm2 of the second ink droplet in the above embodiment. This plot of the ejecting speed Vm1 of the first ink droplet against the ejecting speed Vm2 of the second ink droplet was obtained when the distance S3 between the hitting positions of the two ink droplets ejected in response to the driving signal A was equalized to the distance S13 between the hitting positions of the two ink droplets ejected in response to the driving signal B by the technique of the embodiment, while the moving speed Vc of the carriage 31, the ejection timing difference T0, and the platen gap PG were kept to fixed values.

The concrete procedure set the moving speed Vc of the carriage 31, the ejection timing difference T0, and the platen gap PG respectively equal to 0.508 [m/s], 50 [μs], and 1.2 [mm] and substituted these values into Equation (11) discussed above, so as to determine the relationship between the ejecting speed Vm1 of the first ink droplet and the ejecting speed Vm2 of the second ink droplet. As clearly understood from the graph of FIG. 21, unequivocally determining the ejecting speed Vm2 of the second ink droplet against the ejecting speed Vm1 of the first ink droplet causes a difference d between the distance S3 and the distance S13 to be on the plot of d=0, thereby equalizing the distance S3 with the distance S13. The difference d is calculated by the left side of Equation (11) and expressed by Equation (19) given below:

$$d=|12Vc(\mathrm{T0}+PG/\mathrm{Vm2}-PG/\mathrm{Vm1})| \tag{19}$$

The procedure of the above embodiment carries out the regulation to make the distance S3 substantially equal to the distance S13, that is, to make the difference d substantially equal to zero. A first possible modification carries out the regulation to make half the difference d (hereinafter referred to as a variation D) within a predetermined value. The difference d between the distance S3 and the distance S13 corresponds to the sum of the distance between the first ink droplet and the second ink droplet in each of the two adjoining pixels. With regard to one pixel, half the difference d corresponds to the distance between the first ink droplet and the second ink droplet. The first modification thus carries out the settings to make half the difference d or the variation D within a predetermined value. The variation D is obtained by halving the right side of Equation (19) as expressed by Equation (20) given below:

$$D=|Vc(\mathrm{T0}+PG/\mathrm{Vm2}-PG/\mathrm{Vm1})| \tag{20}$$

Figure 22:
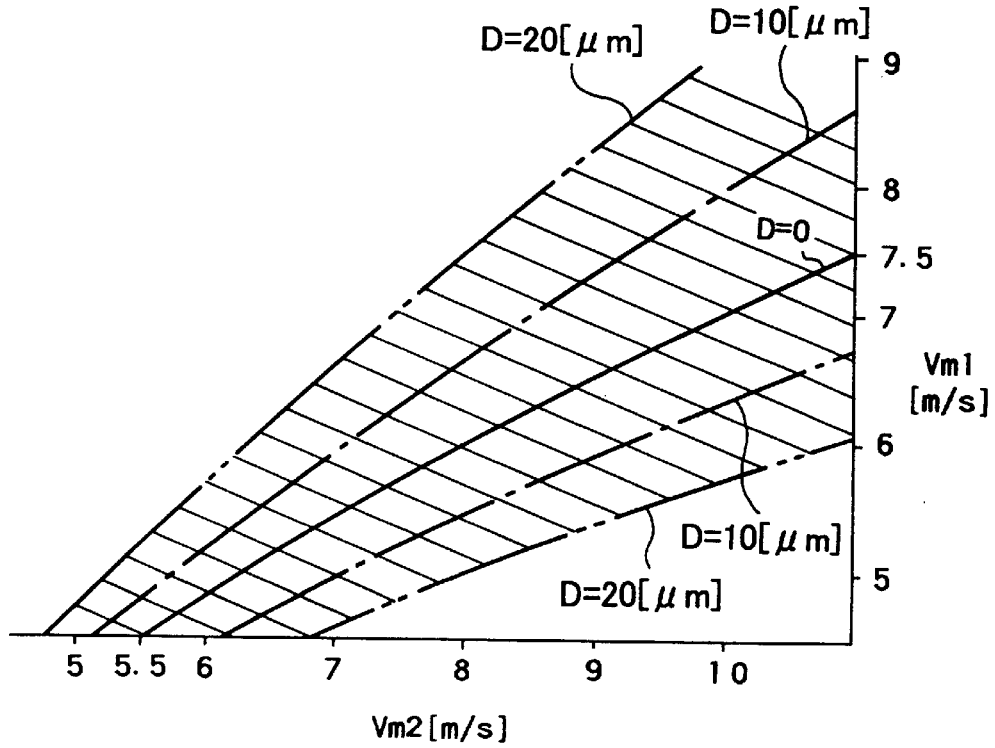
FIG. 22 is a graph showing the ejecting speed Vm1 of the first ink droplet plotted against the ejecting speed Vm2 of the second ink droplet with regard to a variety of allowable variations D.

FIG. 22 is a graph showing the ejecting speed Vm1 of the first ink droplet plotted against the ejecting speed Vm2 of the second ink droplet with regard to a variety of allowable variations D. The one-dot chain lines define an area with the allowable variation D equal to 10 [μm], whereas the two-dot chain lines define an area with the allowable variation D equal to 20 [μm].

The allowable variation D of 20 [μm] is substantially equal to half a size R of one dot (approximately 8 [μm]) when the printing resolution is set to 720 [dpi]. The first modification sets half the size R of one dot to the allowable range of the variation D. When the variation D defined by the ejecting speed Vm1 of the first ink droplet and the ejecting speed Vm2 of the second ink droplet is a value included in the hatched area, the variation D is kept within a relatively small value 20 [μm], which is substantially equal to half the size R of one dot.

The allowable range of the variation D is set equal to half the size R of one dot, because of the following reason. In the case where the variation D is set equal to, for example, the size R of one dot, the distance S13 between the hitting positions of a large ink droplet and a small ink droplet ejected in this sequence is equal to zero. This means that the large ink droplet and the small ink droplet overlap each other. The distance S3 between the hitting positions of a small ink droplet and a large ink droplet ejected in this sequence, on the other hand, is relatively large value. In this case, the shape of dots created by two ink droplets in response to the driving signal A is thus significantly different from the shape of dots created by two ink droplets in response to the driving signal B. In the case where the allowable range of the variation D is set equal to half the size R of one dot, on the other hand, the difference between the distance S3 and the distance S13 is not greater than the size R of one dot. The shape of dots created by two ink droplets in response to the driving signal A is thus substantially similar to the shape of dots created by two ink droplets in response to the driving signal B. The procedure of this first modification reduces the variation in inter-dot distance between two different types of dots having different sizes with regard to the different combinations of selected driving pulses, and thereby ensures the high picture quality of the resulting printed image.

The technique of the above embodiment causes one ink droplet to be ejected from the print head 28 in response to one driving pulse. A second possible modification uses a different print head, which generates a fine satellite particle in the process of separating a main particle for creating each ink droplet from a flow of ink jet and ejects both the main particle and the satellite particle.

Figure 23:
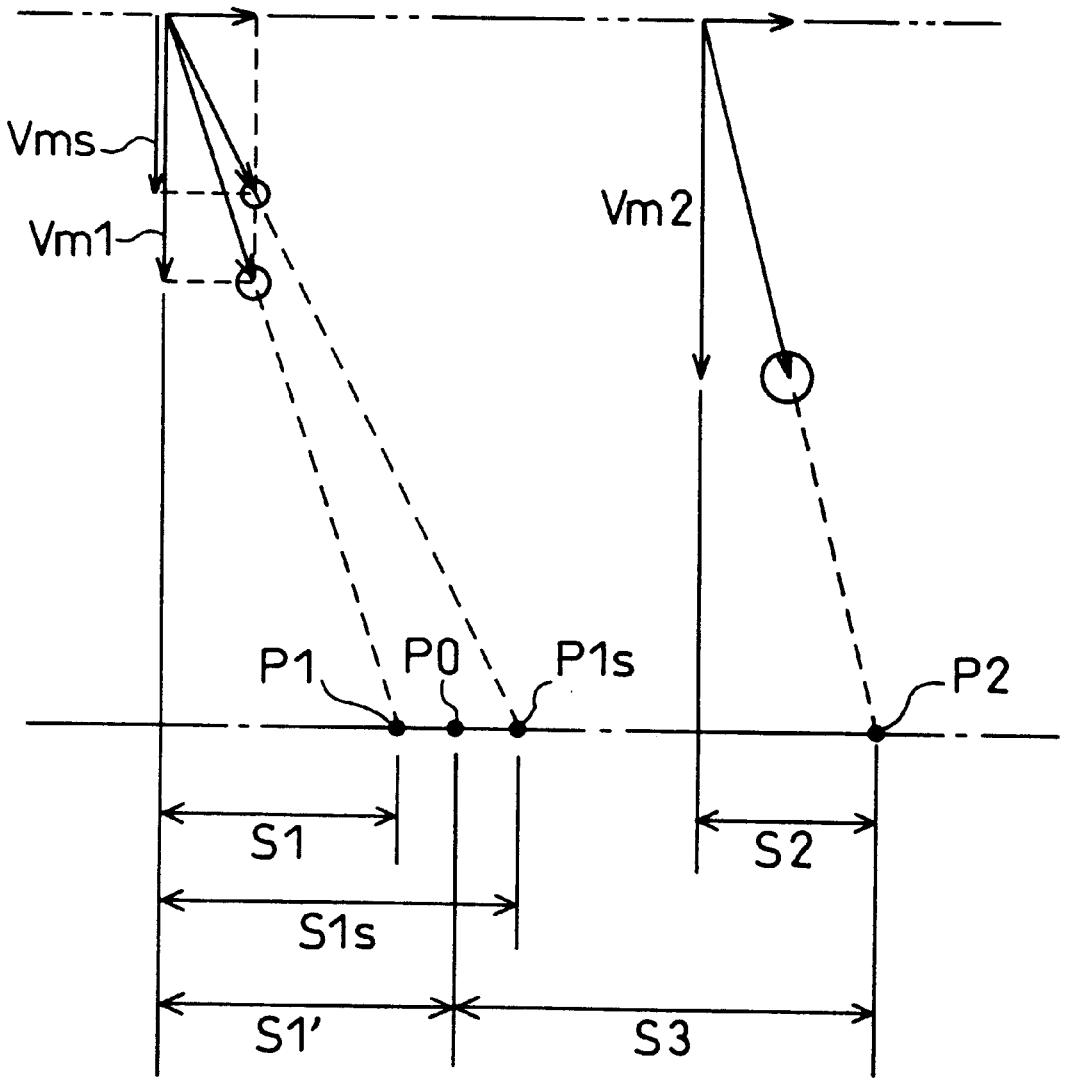
FIG. 23 shows the hitting positions of ink droplets when a print head that enables an ink droplet ejected from the nozzle to be divided into a main particle and a satellite particle is driven in response to the driving signal A.

FIG. 23 shows the hitting positions of ink droplets when such a print head is driven in response to the driving signal A discussed in the above embodiment. An ink droplet ejected in response to the first pulse of the driving signal (the left side in FIG. 23) is divided into a main particle IP1 and a satellite particle IPs. The main particle IP1 is ejected downward in the vertical direction at an ejecting speed Vm1, whereas the satellite particle IPs is ejected downward in the vertical direction at an ejecting speed Vms.

A distance S1 representing a hitting position P1 of the main particle IP1 on the printing paper is expressed by Equation (3) discussed above. A distance S1s representing a hitting position P1s of the satellite particle IPs on the printing paper is, on the other hand, expressed by Equation (21) given below:

$$\mathrm{S1s}=PG\cdot Vc/Vms \tag{21}$$

A distance S1' that represents a middle point P0 between the hitting position P1 of the main particle IP1 and the hitting position P1s of the satellite particle IPs is expressed by Equation (22) given below:

$$\begin{aligned} S1' &= (S1+S1s)/2 \\ &= PG\cdot Vc(1/Vm1+1/Vms)/2 \end{aligned} \tag{22}$$

The second modification regards the middle point P0 defined by the distance S1' as the hitting position of the ink droplet corresponding to the first pulse, and calculates a distance S3 between the middle point P0 and a hitting position P2 of a large ink droplet according to Equation (23) given below:

$$\begin{aligned} S3 &= S0+S2-S1' \\ &= Vc(Tf+T0)+PG\cdot Vc/Vm2- \\ &\quad PG\cdot Vc(1/Vm1+1/Vms)/2 \end{aligned} \tag{23}$$

This determines the distance S3 between a small ink droplet and a large ink droplet ejected in response to the driving signal A. In a similar manner, the middle point between the hitting positions of the main particle and the satellite particle is regarded as the hitting position of an ink droplet, so that the distance S13 between the large ink droplet and the small ink droplet ejected in the inverted sequence in response to the driving signal B is determined. The distances S3 and S13 calculated in this manner are used for a variety of calculations discussed above in the embodiment. Like the embodiment discussed above, the second modification reduces the variation in distance between two different types of dots, a medium dot and a small dot, in the structure with the print head that enables ejection of both a main particle and a satellite particle. This accordingly ensures the excellent picture quality of the resulting printed image.

The technique of the above embodiment ejects two different types of ink droplets having different sizes, that is, a large ink droplet and a small ink droplet, in response to the driving signal COM. A third possible modification ejects a plurality of ink droplets having a substantially fixed size in response to the driving signal COM. Like the embodiment discussed above, this arrangement reduces the variation in inter-dot distance.

In the embodiment discussed above, the driving signal COM includes the first pulse and the second pulse for ejecting two different types of ink droplets in one recording cycle corresponding to one pixel in recording. In a fourth possible modification, the driving signal includes three or more pulses for ejecting three or more ink droplets.

Figure 24:
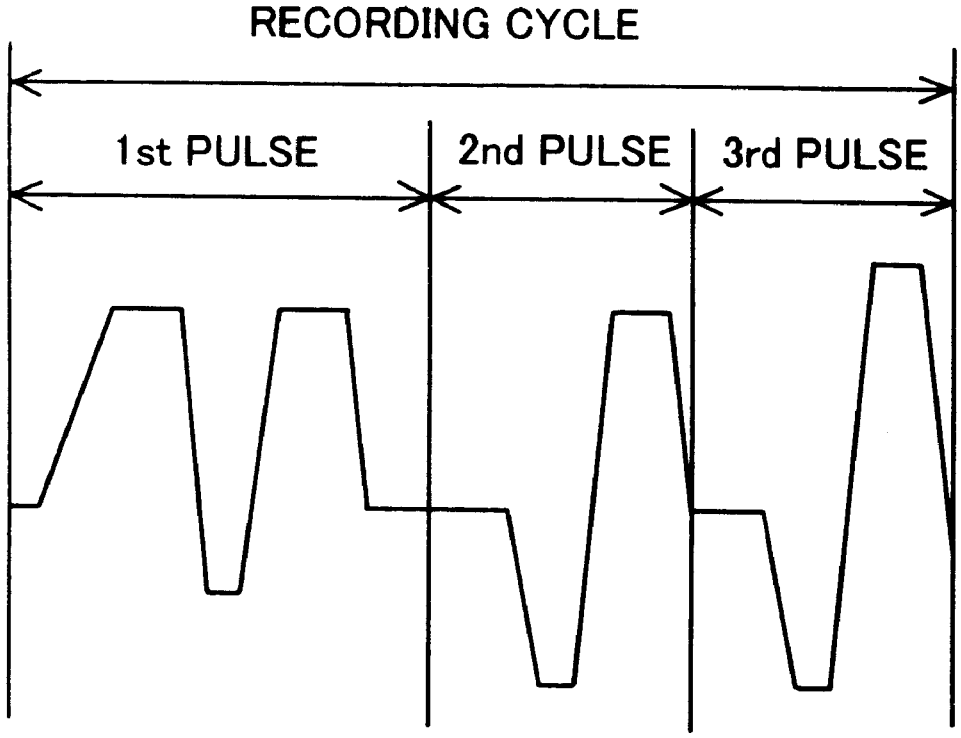
FIG. 24 shows the waveform of a driving signal that includes three or more driving pulses in one cycle corresponding to one pixel.

FIG. 24 shows the waveform of the driving signal in the fourth modification. The driving signal includes a first pulse, a second pulse, and a third pulse in one recording cycle corresponding to one pixel in recording. The first pulse causes ejection of a small ink droplet, the second pulse causes ejection of a medium ink droplet, and the third pulse causes ejection of a large ink droplet. The procedure of the fourth modification selects in advance two pulses among the three options, in order to enable ejection of a specific combination of two ink droplets that maximizes a variation in distance between the hitting positions of two ink droplets when the two ink droplets are ejected in the adjoining pixels in response to the two selected pulses output in an ascending sequence (that is, in the sequence of the first pulse and the second pulse) and in an inverted descending sequence (that is, in the sequence of the second pulse and the first pulse). The procedure then specifies the first pulse, the second pulse, and the third pulse to satisfy Equation (24) given below, with regard to the selected combination of two ink droplets.

$$Vc(\mathrm{T}\mathbf{0}+PG/\mathrm{Vm}\mathbf{2}-PG/\mathrm{Vm}\mathbf{1})\leq R/2 \quad (24)$$

Equation (24) shows that the variation D defined by Equation (20) is within half the size R of one dot, which depends upon the printing resolution. When three or more ink droplets are recorded in one pixel, the arrangement of the fourth modification enables the distance between the hitting positions of two ink droplets ejected in one pixel to be within a predetermined value, with regard to the specific combination of two ink droplets that maximizes the variation in distance between the hitting positions of two ink droplets ejected in response to the two selected pulses output in the ascending sequence and in the descending sequence. This technique effectively prevents deterioration of the picture quality in the structure that enables three or more ink droplets to be recorded in one pixel.

In the embodiment discussed above, the piezoelectric elements are the deflective vibration type PZT. A vertically-vibrating and laterally-affecting type PZT may be used instead. In the latter case, the charging and discharging processes are reversed from those in the case of the deflective vibration type PZT. A variety of elements other than the piezoelectric element, for example, a magnetic deflection element, is applicable for the pressure-generating element. The principle of the present invention is also applicable to another available structure that supplies electricity to a heater disposed in an ink conduit and causes ink droplets to be ejected by means of bubbles generated in the ink conduit.

The present invention is not restricted to the above embodiment or its modifications, but there may be many other modifications, changes, and alterations without departing from the scope or spirit of the main characteristics of the present invention.

The scope and spirit of the present invention are limited only by the terms of the appended claims.

What is claimed is:

1. A printer that prints an image on a printing medium while carrying out a main scan that moves a print head relative to the printing medium, said printer comprising:

said print head that has a plurality of nozzles and a plurality of pressure generating elements, which respectively correspond to the plurality of nozzles, each of the pressure generating elements being driven in response to a driving signal, so as to cause an ink droplet to be ejected from the corresponding nozzle against the printing medium; and a head driving control unit that controls the driving signal output to said print head and thereby causes said print head to print an image on the printing medium, wherein said head driving control unit comprises:

a driving signal generating unit that generates the driving signal that selectively includes a first driving pulse and a second driving pulse in one printing period corresponding to one pixel in printing, a first driving pulse causing a first ink droplet to be ejected from each of the nozzles, a second driving pulse following the first driving pulse and causing a second ink droplet to be ejected from each of the nozzles; and a driving signal specification unit that specifies the first driving pulse and the second driving pulse, in order to cause three factors, that is, an ejecting speed of the first ink droplet towards the printing medium, an ejecting speed of the second ink droplet towards the printing medium, and a variation in time difference between the first driving pulse and the second driving pulse when the first driving pulse and the second driving pulse are respectively output to adjoining pixels in this sequence and in an inverted sequence, to satisfy a predetermined relationship, which depends upon a distance from a nozzle of interest to the printing medium, thereby causing a variation in distance between a hitting position of the first ink droplet and a hitting position of the second ink droplet when the first driving pulse and the second driving pulse are respectively output to the adjoining pixels in this sequence and in the inverted sequence to be within a preset value.

2. A printer in accordance with claim 1, wherein the predetermined relationship adopted in said driving signal specification unit is expressed by an inequality given below:

$$Vc(\mathrm{T}\mathbf{0}+PG/\mathrm{Vm}\mathbf{2}-PG/\mathrm{Vm}\mathbf{1})\leq R/2$$

where Vm1 denotes the ejecting speed of the first ink droplet towards the printing medium, Vm2 denotes the ejecting speed of the second ink droplet towards the printing medium, T0 denotes the variation in time difference between the first driving pulse and the second driving pulse when the first driving pulse and the second driving pulse are respectively output to the adjoining pixels in this sequence and in the inverted sequence, Vc denotes a moving speed of said print head, PG denotes the distance from the nozzle of interest to the printing medium, and R denotes a size of one dot that depends upon a printing resolution.

3. A printer in accordance with claim 1, wherein the predetermined relationship adopted in said driving signal specification unit is expressed by an equation given below:

$$1/Vm1-1/Vm2=T0/PG$$

where Vm1 denotes the ejecting speed of the first ink droplet towards the printing medium, Vm2 denotes the ejecting speed of the second ink droplet towards the printing medium, T0 denotes the variation in time difference between the first driving pulse and the second driving pulse when the first driving pulse and the second driving pulse are respectively output to the adjoining pixels in this sequence and in the inverted sequence, and PG denotes the distance from the nozzle of interest to the printing medium.

4. A printer in accordance with claim 1, wherein said driving signal specification unit comprises:

a control quantity regulation unit that regulates a control quantity, in which only the variation in time difference is variable among the three factors, so as to specify the first driving pulse and the second driving pulse.

5. A printer in accordance with claim 1, wherein said driving signal specification unit comprises:

a control quantity regulation unit that regulates a control quantity, in which only the ejecting speed of the first ink droplet towards the printing medium and the ejecting speed of the second ink droplet towards the printing medium are variable among the three factors, so as to specify the first driving pulse and the second driving pulse.

6. A printer in accordance with claim 1, wherein said print head generates a fine satellite particle in the process of separating a main particle for creating each ink droplet from a flow of ink jet, and ejects both the main particle and the satellite particle, and the distance between the hitting position of the first ink droplet and the hitting position of the second ink droplet regulated by said driving signal specification unit is calculated on the assumption that the hitting position of each ink droplet is in the middle of a hitting position of the main particle and a hitting position of the satellite particle.

7. A printer in accordance with claim 1, wherein said driving signal generating unit generates the driving signal that selectively includes at least three driving pulses, which respectively cause at least three ink droplets to be ejected from each of the nozzles, in one printing period corresponding to one pixel in printing, and said driving signal specification unit applies the technique of specification of the first driving pulse and the second driving pulse for a combination of ejection of two ink droplets, which are selected among ejection of the at least three ink droplets in response to the at least three driving pulses, in order to maximize a variation in distance between hitting positions of the two selected ink droplets when the two selected ink droplets are ejected in a certain sequence and in an inverted sequence.

8. A printer that prints an image on a printing medium while carrying out a main scan that moves a print head relative to the printing medium, said printer comprising:

said print head that has a plurality of nozzles and a plurality of pressure generating elements, which respectively correspond to the plurality of nozzles, each of the pressure generating elements being driven in response to a driving signal, so as to cause an ink droplet to be ejected from the corresponding nozzle against the printing medium;

a head driving control unit that generates the driving signal that selectively includes a first driving pulse and a second driving pulse in one printing period corresponding to one pixel in printing, a first driving pulse causing a first ink droplet to be ejected from each of the nozzles, a second driving pulse following the first driving pulse and causing a second ink droplet to be ejected from each of the nozzles, and outputs the driving signal to said print head, thereby causing said print head to print an image on the printing medium; and a platen gap specification unit that specifies a distance from a nozzle of interest to the printing medium, in order to cause three factors, that is, an ejecting speed of the first ink droplet towards the printing medium, an ejecting speed of the second ink droplet towards the printing medium, and a variation in time difference between the first driving pulse and the second driving pulse when the first driving pulse and the second driving pulse are respectively output to adjoining pixels in this sequence and in an inverted sequence, to satisfy a predetermined relationship, which depends upon the distance from the nozzle of interest to the printing medium, thereby causing a variation in distance between a hitting position of the first ink droplet and a hitting position of the second ink droplet when the first driving pulse and the second driving pulse are respectively output to the adjoining pixels in this sequence and in the inverted sequence to be within a preset value.

9. A printer in accordance with claim 8, wherein said print head generates a fine satellite particle in the process of separating a main particle for creating each ink droplet from a flow of ink jet, and ejects both the main particle and the satellite particle, and the distance between the hitting position of the first ink droplet and the hitting position of the second ink droplet regulated by said platen gap specification unit is calculated on the assumption that the hitting position of each ink droplet is in the middle of a hitting position of the main particle and a hitting position of the satellite particle.

10. A printer in accordance with claim 8, wherein said head driving control unit generates the driving signal that selectively includes at least three driving pulses, which respectively cause at least three ink droplets to be ejected from each of the nozzles, in one printing period corresponding to one pixel in printing, and said platen gap specification unit applies the technique of specification of the distance from the nozzle of interest to the printing medium for a combination of ejection of two ink droplets, which are selected among ejection of the at least three ink droplets in response to the at least three driving pulses, in order to maximize a variation in distance between hitting positions of the two selected ink droplets when the two selected ink droplets are ejected a certain sequence and in an inverted sequence.

11. A method of printing an image on a printing medium while carrying out a main scan that moves a print head relative to the printing medium, wherein said print head has a plurality of nozzles and a plurality of pressure generating elements, which respectively correspond to the plurality of nozzles, each of the pressure generating elements being driven in response to a driving signal, so as to cause an ink droplet to be ejected from the corresponding nozzle against the printing medium, said method comprising the step of:

(a) controlling the driving signal output to said print head and thereby causing said print head to print an image on the printing medium, wherein said step (a) comprises the steps of:

(al) generating the driving signal that selectively includes a first driving pulse and a second driving pulse in one printing period corresponding to one pixel in printing, a first driving pulse causing a first ink droplet to be ejected from each of the nozzles, a second driving pulse following the first driving pulse and causing a second ink droplet to be ejected from each of the nozzles; and (a2) specifying the first driving pulse and the second driving pulse, in order to cause three factors, that is, an ejecting speed of the first ink droplet towards the printing medium, an ejecting speed of the second ink droplet towards the printing medium, and a variation in time difference between the first driving pulse and the second driving pulse when the first driving pulse and the second driving pulse are respectively output to adjoining pixels in this sequence and in an inverted sequence, to satisfy a predetermined relationship, which depends upon a distance from a nozzle of interest to the printing medium, thereby causing a variation in distance between a hitting position of the first ink droplet and a hitting position of the second ink droplet when the first driving pulse and the second driving pulse are respectively output to the adjoining pixels in this sequence and in the inverted sequence to be within a preset value.

12. A method in accordance with claim 11, wherein the predetermined relationship adopted in said step (a2) is expressed by an inequality given below:

$$Vc(\mathrm{T0}+PG/\mathrm{Vm2}-PG/\mathrm{Vm1})\leqq R/2$$

where Vm1 denotes the ejecting speed of the first ink droplet towards the printing medium, Vm2 denotes the ejecting speed of the second ink droplet towards the printing medium, T0 denotes the variation in time difference between the first driving pulse and the second driving pulse when the first driving pulse and the second driving pulse are respectively output to the adjoining pixels in this sequence and in the inverted sequence, Vc denotes a moving speed of said print head, PG denotes the distance from the nozzle of interest to the printing medium, and R denotes a size of one dot that depends upon a printing resolution.

13. A method in accordance with claims 11, wherein the predetermined relationship adopted in said step (a2) is expressed by an equation given below:

$$1/\mathrm{Vm1}-1/\mathrm{Vm2}=\mathrm{T0}/PG$$

where Vm1 denotes the ejecting speed of the first ink droplet towards the printing medium, Vm2 denotes the ejecting speed of the second ink droplet towards the printing medium, T0 denotes the variation in time difference between the first driving pulse and the second driving pulse when the first driving pulse and the second driving pulse are respectively output to the adjoining pixels in this sequence and in the inverted sequence, and PG denotes the distance from the nozzle of interest to the printing medium.

14. A method in accordance with claim 11, wherein said step (a2) comprises the step of:

regulating a control quantity, in which only the variation in time difference is variable among the three factors, so as to specify the first driving pulse and the second driving pulse.

15. A method in accordance with claim 11, wherein said step (a2) comprises the step of:

regulating a control quantity, in which only the ejecting speed of the first ink droplet towards the printing medium and the ejecting speed of the second ink droplet towards the printing medium are variable among the three factors, so as to specify the first driving pulse and the second driving pulse.

16. A method in accordance with claim 11, wherein said print head generates a fine satellite particle in the process of separating a main particle for creating each ink droplet from a flow of ink jet, and ejects both the main particle and the satellite particle, and the distance between the hitting position of the first ink droplet and the hitting position of the second ink droplet regulated in said step (a2) is calculated on the assumption that the hitting position of each ink droplet is in the middle of a hitting position of the main particle and a hitting position of the satellite particle.

17. A method in accordance with claim 11, wherein said step (al) comprises the step of:

generating the driving signal that selectively includes at least three driving pulses, which respectively cause at least three ink droplets to be ejected from each of the nozzles, in one printing period corresponding to one pixel in printing, and said step (a2) comprises the step of:

applying the technique of specification of the first driving pulse and the second driving pulse for a combination of ejection of two ink droplets, which are selected among ejection of the at least three ink droplets in response to the at least three driving pulses, in order to maximize a variation in distance between hitting positions of the two selected ink droplets when the two selected ink droplets are ejected in a certain sequence and in an inverted sequence.

18. A method of printing an image on a printing medium while carrying out a main scan that moves a print head relative to the printing medium, wherein said print head has a plurality of nozzles and a plurality of pressure generating elements, which respectively correspond to the plurality of nozzles, each of the pressure generating elements being driven in response to a driving signal, so as to cause an ink droplet to be ejected from the corresponding nozzle against the printing medium, said method comprising the steps of:

(a) generating the driving signal that selectively includes a first driving pulse and a second driving pulse in one printing period corresponding to one pixel in printing, a first driving pulse causing a first ink droplet to be ejected from each of the nozzles, a second driving pulse following the first driving pulse and causing a second ink droplet to be ejected from each of the nozzles, and outputting the driving signal to said print head, thereby causing said print head to print an image on the printing medium; and (b) specifying a distance from a nozzle of interest to the printing medium, in order to cause three factors, that is, an ejecting speed of the first ink droplet towards the printing medium, an ejecting speed of the second ink droplet towards the printing medium, and a variation in time difference between the first driving pulse and the second driving pulse when the first driving pulse and the second driving pulse are respectively output to adjoining pixels in this sequence and in an inverted sequence, to satisfy a predetermined relationship, which depends upon the distance from the nozzle of interest to the printing medium, thereby causing a variation in distance between a hitting position of the first ink droplet and a hitting position of the second ink droplet when the first driving pulse and the second driving pulse are respectively output to the adjoining pixels in this sequence and in the inverted sequence to be within a preset value.

19. A method in accordance with claim 18, wherein said print head generates a fine satellite particle in the process of separating a main particle for creating each ink droplet from a flow of ink jet, and ejects both the main particle and the satellite particle, and the distance between the hitting position of the first ink droplet and the hitting position of the second ink droplet regulated in said step (b) is calculated on the assumption that the hitting position of each ink droplet is in the middle of a hitting position of the main particle and a hitting position of the satellite particle.

20. A method in accordance with claim 18, wherein said step (a) comprises the step of:

generating the driving signal that selectively includes at least three driving pulses, which respectively cause at least three ink droplets to be ejected from each of the nozzles, in one printing period corresponding to one pixel in printing, and said step (b) comprises the step of:

applying the technique of specification of the distance from the nozzle of interest to the printing medium for a combination of ejection of two ink droplets, which are selected among ejection of the at least three ink droplets in response to the at least three driving pulses, in order to maximize a variation in distance between hitting positions of the two selected ink droplets when the two selected ink droplets are ejected in a certain sequence and in an inverted sequence.

* * * * *